US007849609B2

(12) United States Patent
Edington et al.

(10) Patent No.: US 7,849,609 B2
(45) Date of Patent: Dec. 14, 2010

(54) INTERIOR AND UPPER MEMBERS FOR ARTICLES OF FOOTWEAR AND OTHER FOOT-RECEIVING DEVICES

(75) Inventors: Christopher Edington, Portland, OR (US); John Baier, Hampton Falls, NH (US); Eric Swartz, Merrimac, MA (US); Bruce J. Kilgore, Lake Oswego, OR (US); Tina Casillas, Portland, OR (US); Alexandre Baudouin, Portland, OR (US); Jeffrey C. Pisciotta, Oregon City, OR (US)

(73) Assignees: Nike, Inc., Beaverton, OR (US); Converse, Inc., North Andover, MA (US)

( * ) Notice: Subject to any disclaimer, the term of this patent is extended or adjusted under 35 U.S.C. 154(b) by 586 days.

(21) Appl. No.: 11/394,340

(22) Filed: Mar. 31, 2006

(65) Prior Publication Data

US 2007/0227038 A1 Oct. 4, 2007

(51) Int. Cl.
*A43B 23/00* (2006.01)

(52) U.S. Cl. ..... 36/48; 36/10; 36/55

(58) Field of Classification Search ..... 36/48, 36/10, 55, 45, 49, 7.1 R
See application file for complete search history.

(56) References Cited

U.S. PATENT DOCUMENTS

| | | | | |
|---|---|---|---|---|
| 988,159 | A * | 3/1911 | Wiltse | 36/7.1 R |
| 1,104,357 | A * | 7/1914 | Hassel | 36/11 |
| 1,521,853 | A * | 1/1925 | Augustine | 36/11 |
| 1,748,607 | A * | 2/1930 | Jarrett | 36/1 |
| 2,034,091 | A * | 3/1936 | Dunbar | 36/4 |
| 2,317,879 | A * | 4/1943 | Bingham, Jr. | 36/4 |
| 2,384,927 | A * | 9/1945 | Julianelli | 36/11 |
| 2,748,501 | A * | 6/1956 | Martin et al. | 36/11 |
| 2,974,427 | A * | 3/1961 | Wolff | 36/11 |

(Continued)

FOREIGN PATENT DOCUMENTS

CN 20078017955 6/2009

(Continued)

OTHER PUBLICATIONS

International Preliminary Report on Patentability in corresponding PCT Application, International App. No. PCT/US2007/007480, mailed Oct. 9, 2008.

(Continued)

*Primary Examiner*—Ted Kavanaugh
(74) *Attorney, Agent, or Firm*—Shook, Hardy & Bacon LLP

(57) ABSTRACT

Interior members for foot-receiving devices, such as bootie elements for articles of footwear, include a material element at least partially defining a foot-receiving chamber. This material element may include, in some examples, a heel-surrounding portion, a lateral side portion, a medial side portion, and a seamless plantar portion in a continuous, one-piece arrangement. Additionally or alternatively, in some examples, the material element may include a heel-surrounding portion, a lateral side portion, a medial side portion, a plantar surface, and a double layer of the material element at least along an Achilles area portion. Additional aspects relate to material blanks for forming such interior members as well as to foot-receiving devices, such as athletic footwear, including such interior members.

21 Claims, 21 Drawing Sheets

U.S. PATENT DOCUMENTS

| | | | | | |
|---|---|---|---|---|---|
| 2,986,823 | A | * | 6/1961 | Kos | 36/7.1 R |
| 3,289,328 | A | * | 12/1966 | Abel | 36/9 R |
| 4,130,947 | A | | 12/1978 | Denu | |
| 4,151,661 | A | | 5/1979 | Namba et al. | |
| 4,309,832 | A | | 1/1982 | Hunt | |
| 4,366,634 | A | | 1/1983 | Giese et al. | |
| 4,550,446 | A | | 11/1985 | Herman | |
| 4,557,059 | A | | 12/1985 | Misevish et al. | |
| 4,947,560 | A | | 8/1990 | Fuerst et al. | |
| 4,976,050 | A | * | 12/1990 | Houghteling | 36/9 R |
| 5,533,279 | A | | 7/1996 | Mitsui et al. | |
| 5,544,429 | A | | 8/1996 | Ellis, III | |
| 5,572,805 | A | | 11/1996 | Giese et al. | |
| 6,065,230 | A | | 5/2000 | James | |
| 6,314,662 | B1 | | 11/2001 | Ellis, III | |
| 6,519,875 | B1 | | 2/2003 | Beard | |
| 6,609,312 | B1 | | 8/2003 | Ellis, III | |
| 6,668,470 | B2 | | 12/2003 | Ellis, III | |
| 6,708,424 | B1 | | 3/2004 | Ellis, III | |
| 6,968,637 | B1 | | 11/2005 | Johnson | |
| 2001/0001907 | A1 | | 5/2001 | Luthi et al. | |
| 2003/0131497 | A1 | | 7/2003 | Ellis, III | |
| 2003/0167656 | A1 | | 9/2003 | Tung | |
| 2004/0139628 | A1 | | 7/2004 | Wiener | |
| 2005/0022426 | A1 | * | 2/2005 | Clark et al. | 36/30 R |
| 2005/0188562 | A1 | * | 9/2005 | Clarke et al. | 36/15 |

FOREIGN PATENT DOCUMENTS

| | | | |
|---|---|---|---|
| DE | 102005021143 | | 11/2006 |
| EP | 1002473 | A1 | 5/2000 |
| EP | 1402796 | A1 | 3/2004 |
| EP | 1428447 | A1 | 6/2004 |
| FR | 761540 | | 3/1934 |
| FR | 2386276 | | 11/1978 |
| WO | 03075698 | A1 | 9/2003 |

OTHER PUBLICATIONS

Partial International Search Report in corresponding PCT Application, International App. No. PCT/US2007/007480, mailed Oct. 1, 2007.

International Search Report with Written Opinion issued in PCT/US2007/007480, dated Dec. 11, 2007.

International Search Report with Written Opinion issued in PCT/US2007/007481, dated Oct. 15, 2007.

International Preliminary Report on Patentability issued in PCT/US2007/007481, dated Oct. 9, 2008.

* cited by examiner

INTERIOR AND UPPER MEMBERS FOR ARTICLES OF FOOTWEAR AND OTHER FOOT-RECEIVING DEVICES

FIELD OF THE INVENTION

This invention relates to interior members for articles of footwear or other foot-receiving devices, such as interior bootie elements, as well as to upper members, articles of footwear, and/or other foot-receiving devices including such interior members.

BACKGROUND

Conventional articles of athletic footwear have included two primary elements, namely an upper member and a sole member or structure. The upper member provides a covering for the foot that securely receives and positions the foot with respect to the sole structure. In addition, the upper member may have a configuration that protects the foot and provides ventilation, thereby cooling the foot and removing perspiration. The sole structure generally is secured to a lower portion of the upper member and generally is positioned between the foot and the ground or other contact surface. In addition to attenuating ground reaction forces, the sole structure may provide traction and control foot motions, such as pronation. Accordingly, the upper member and the sole structure operate cooperatively to provide a comfortable structure that is suited for a variety of ambulatory activities, such as walking and running.

The sole member or structure of athletic footwear generally exhibits a layered configuration that includes a comfort-enhancing insole, a resilient midsole formed from a polymer foam material, and a ground-contacting outsole that provides both abrasion-resistance and traction. The midsole is the primary sole structure element that attenuates ground reaction forces and controls foot motions. Suitable polymer foam materials for the midsole include ethylvinylacetate or polyurethane that compress resiliently under an applied load to attenuate ground reaction forces. Conventional polymer foam materials are resiliently compressible, in part, due to the inclusion of a plurality of open or closed cells that define an inner volume substantially displaced by gas.

SUMMARY OF THE INVENTION

Aspects of this invention relate to interior members for foot-receiving devices. Interior members according to at least some examples of the invention may include a first material element at least partially defining a foot-receiving chamber. This first material element may include, in at least some examples, a heel-surrounding portion, a lateral side portion, a medial side portion, and a seamless plantar portion in a continuous, one-piece arrangement. Furthermore, in at least some examples of the invention, the first material element may include a heel-surrounding portion, a lateral side portion, a medial side portion, a plantar surface, and a double layer of the material element at least along an Achilles area portion (and optionally, if desired, at least along an extended lateral ankle area and/or an extended medial ankle area). The interior member further may include a second material element, e.g., including a tongue portion, engaged with the first material element, e.g., to at least partially define an instep portion of the foot-receiving chamber. The interior member may be sized and shaped so as to cover a wearer's ankle.

Providing an interior bootie member having a seamless plantar portion, e.g., with no additional insole member, sock liner, or the like, allows direct wearer foot contact (optionally with a conventional fabric sock material on the wearer's foot) with the bootie member. Also, in at least some example structures, there can be direct contact between the bootie member and a midsole or other impact-attenuating portion of the footwear sole structure. This arrangement can help provide a "lower" footwear structure, can help enable the footwear structure to better conform to the wearer's foot, and can help provide a comfortable fit. Elimination of the insole member and/or sock liner also can eliminate at least some bulk and/or at least one layer of adhesive material in the footwear structure (as well as the corresponding stiffness properties associated with such adhesives), which also can assist in providing a lightweight footwear structure and comfortable fit.

Additional aspects of this invention relates to blanks for forming interior members for foot-receiving devices, e.g., of the types described above. Such blanks may include a first material element defining: (a) a plantar region, (b) a heel-containing region extending from a first side of the plantar region, the heel-containing region defining a first end of the bootie blank, (c) a lateral side region extending from a second side of the plantar region, the lateral side region including a lateral side edge extending in a direction toward the heel-containing region, and (d) a medial side region extending from a third side of the plantar region, the medial side region including a medial side edge extending in a direction toward the heel-containing region. The blank may be structured such that the plantar region, the heel-containing region, the lateral side region, and the medial side region exist in a continuous, seamless arrangement. Other blanks according to at least some examples of this invention may include a first material element defining: (a) a plantar region, (b) a heel-containing region contiguous with and extending from a first side of the plantar region, the heel-containing region defining a first end of the blank, (c) a lateral side region contiguous with and extending from a second side of the plantar region, (d) a medial side region contiguous with and extending from a third side of the plantar region, and (e) an extended Achilles area engaging portion extending from the first end for forming a double layer of the material element in an Achilles area when forming an interior member structure. Double layers of the material element also may be present in other locations, such as along the lateral ankle area, along the medial ankle area, over open portions of an upper member, etc.

Still additional aspects of this invention relate to foot-receiving device products that include interior members (e.g., bootie elements), for example, of the various types and/or formed from blanks of the various types described above. The interior members may be engaged with at least one foot-receiving device component, such as one or more members selected from the group of: a tongue member, a tongue cover member, at least a portion of a sole or other foot-supporting member structure, a midsole member, an outsole member, at least a portion of an upper member, a heel counter, etc. Any type of foot-receiving device products may be provided with interior members of the types described above, such as articles of footwear, including athletic footwear, such as basketball shoes and the like.

BRIEF DESCRIPTION OF THE DRAWINGS

The present invention is illustrated by way of example and is not limited in the accompanying figures, in which like reference numerals indicate similar elements throughout, and in which.

DETAILED DESCRIPTION

Figure 1A:
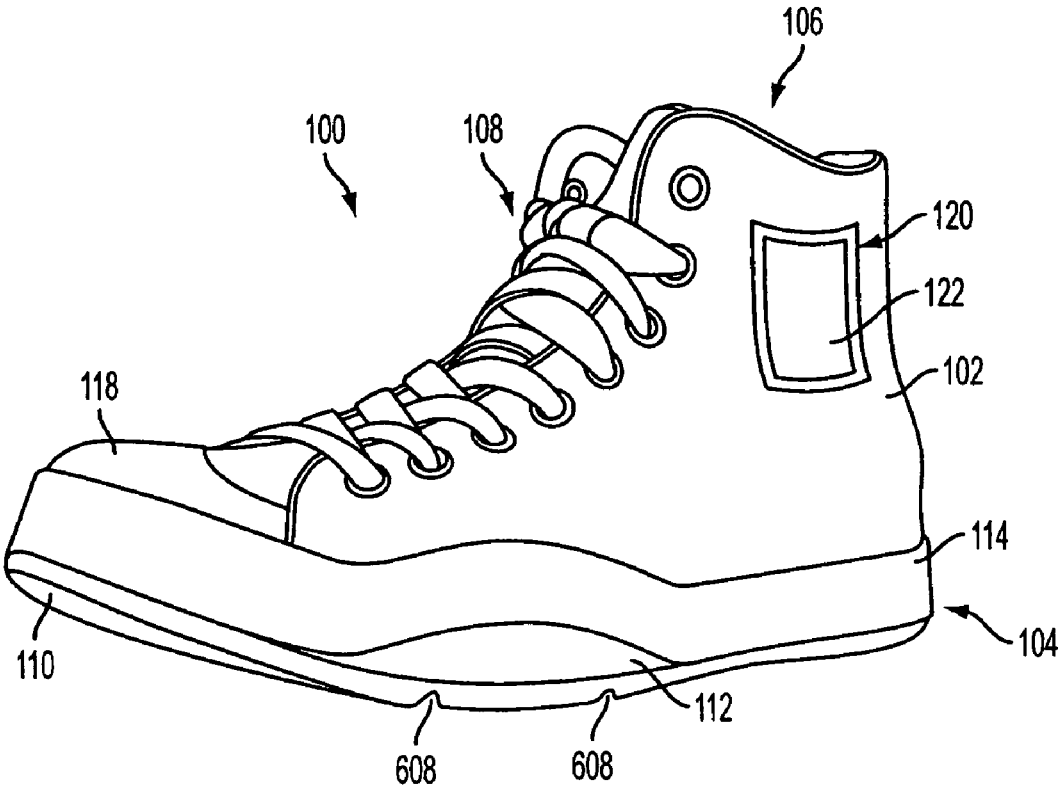
FIGS. 1A through 1C illustrate various views of an example footwear product including various features of the present invention.

In the following description of various examples of the invention, reference is made to the accompanying drawings, which form a part hereof, and in which are shown by way of illustration various example articles of footwear, systems, and environments in which aspects of the invention may be practiced. It is to be understood that other specific arrangements of parts, articles of footwear, other foot-receiving devices, example systems, and environments may be utilized and take advantage of features of the invention, and structural and functional modifications may be made from the specific examples disclosed without departing from the scope of the present invention. Also, while the terms "top," "bottom," "side," "front," "back," "above," "below," "under," "over," and the like may be used in this specification to describe various example features and elements of the invention, these terms are used herein as a matter of convenience, e.g., based on the example orientations shown in the figures and/or a typical orientation during use. Nothing in this specification should be construed as requiring a specific three dimensional orientation of structures in order to fall within the scope of this invention.

To assist the reader, this specification is broken into various subsections, as follows: Terms; General Description of Aspects of the Invention; Specific Examples of Bootie and Foot-Receiving Device Structures According to the Invention; and Conclusion.

I. Terms

The following terms are used in this specification, and unless otherwise noted or clear from the context, these terms have the meanings provided below.

"Foot-receiving device" means any device into which a user places at least some portion of his or her foot. In addition to all types of "footwear" (described below), "foot-receiving devices" include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like.

"Footwear" means any type of product worn on the feet, and this term includes, but is not limited to: all types of shoes, boots, sneakers, sandals, thongs, flip-flops, mules, scuffs, slippers, sport-specific shoes (such as basketball shoes, golf shoes, tennis shoes, baseball cleats, soccer or football cleats, ski boots, etc.), and the like. "Footwear" may protect the feet from the environment and/or enhance a wearer's performance (e.g., physically, physiologically, medically, etc.).

"Foot-covering members" include one or more portions of a foot-receiving device that extend at least partially over and/or at least partially cover at least some portion of the wearer's foot, e.g., so as to assist in holding the foot-receiving device on and/or in place with respect to the wearer's foot. "Foot-covering members" include, but are not limited to, upper members, e.g., of the type provided in some conventional footwear products.

"Foot-supporting members" include one or more portions of a foot-receiving device that extend at least partially beneath at least some portion of the wearer's foot, e.g., so as to assist in supporting the foot and/or attenuating the reaction forces to which the wearer's foot would be exposed, for example, when stepping down, landing a jump, and/or otherwise using the foot-receiving device. "Foot-supporting members" include, but are not limited to, sole members, e.g., of the type provided in some conventional footwear products. Such sole members may include conventional outsole, midsole, and/or insole members.

"Ground-contacting elements" or "members" include at least some portions of a foot-receiving device structure that contact the ground or any other surface in use, and/or at least some portions of a foot-receiving device structure that engage another element or structure in use (e.g., engage another part of a video game structure, etc.). Such "ground-contacting elements" may include, for example, but are not limited to, outsole elements, e.g., like those provided in some conventional footwear products. "Ground-contacting elements" in at least some example structures may be made of suitable and conventional materials to provide long wear, traction, and protect the foot and/or to prevent the remainder of the foot-receiving device structure from wear effects, e.g., when contacting the ground and/or engaging another surface or structure in use.

II. General Description of Aspects of the Invention

In the description that follows, various connections and/or engagements are set forth between elements in the overall structures. The reader should understand that these connections and/or engagements in general and, unless specified otherwise, may be direct or indirect and that this specification is not intended to be limiting in this respect.

A. Interior Member/Bootie Structures

Aspects of this invention relate to structures used in articles of footwear or other foot-receiving devices, e.g., including structures for contacting and/or holding a wearer's foot. Some more specific example structures and aspects of this invention relate to interior members, such as bootie structures, for foot-receiving device interiors (such as the interior chamber of an article of footwear, such as athletic footwear (e.g., basketball sneakers, high top or ankle covering footwear, etc.)). Bootie structures in accordance with at least some examples of this invention may include a first material element at least partially defining a foot-receiving chamber. The material element in this example bootie structure may include a heel-surrounding portion, a lateral side portion, a medial side portion, and a seamless plantar portion, wherein the first material element includes the plantar portion, the heel-surrounding portion, the lateral side portion, and the medial side portion in a one-piece and/or seamless arrangement. Bootie structures in accordance with at least some examples of this invention further may include a tongue portion included as part of or engaged with the first material element, wherein this tongue portion at least partially defines an instep portion of the foot-receiving chamber.

As noted above, bootie structures in accordance with at least some examples of this invention may include the plantar portion, the heel-surrounding portion, the lateral side portion, and the medial side portion as a continuous, one-piece arrangement. In such bootie structures, a first seam may join a lateral edge of the heel-surrounding portion with a lateral edge of the lateral side portion, and a second seam may join a medial edge of the heel-surrounding portion with a medial edge of the medial side portion. If desired, in at least some structures, the lateral side portion and the medial side portion of the bootie may be seamless and contiguous with the plantar portion, thereby providing a comfortable, smooth, seam-free surface for the plantar and side regions of the foot. Additionally, when present, the tongue portion of the bootie structure may be joined to the first material element via at least a third seam that joins a lateral edge of the tongue portion with a lateral edge of the lateral side portion and/or a fourth seam that joins a medial edge of the tongue portion with a medial edge of the medial side portion. Alternatively, if desired, the tongue portion may be continuously formed with at least one of the lateral or medial side portions and/or the front portion of the bootie structure such that at least one seam or a portion thereof may be eliminated.

Providing an interior bootie member having a seamless plantar portion, as described above, can provide a very comfortable fit. Other features of at least some example structures according to the invention also can help provide various fit features. For example, if desired, when using a bootie member in accordance with at least some examples of this invention, a conventional insole member, sock liner element, or the like can be eliminated. In effect, in such structures, there can be direct contact between the wearer's foot (optionally with a sock on) and the bootie member. Also, if desired, there can be direct contact between the bootie member and a midsole or other impact-attenuating element of the footwear structure. These features can help provide a comfortable, "lower" fit and footwear structure (e.g., an overall thinner sole structure and/or heel portion in the final footwear product), and they also can enable the footwear structure to better conform to the wearer's foot (e.g., by allowing the upper member to better conform to the midsole structure and/or the wearer's foot). Also, elimination of insole members and/or sock liners from the footwear structure can eliminate bulk and/or at least one adhesive layer from the overall footwear structure, as well as the corresponding stiffness associated with inclusion of such adhesives and/or bulk.

Aspects of this invention also relate to foot-receiving device interior members (such as interior booties for articles of footwear, including athletic footwear, such as sneakers, tennis shoes, high top shoes, basketball shoes, etc.) that include a first material element (e.g., a soft fabric or foam material) at least partially defining a foot-receiving chamber, wherein a double layer of the material element is provided at least along an Achilles area portion of the interior member structure. If desired, the foot-receiving device interior member additionally may include one or more of a heel-surrounding portion, a lateral side portion, a medial side portion, a plantar surface, an ankle-containing portion, etc., e.g., to form a complete bootie structure, in some examples. In the final foot-receiving device structure, one layer of the double layer of the material element in the Achilles area may remain exposed and open (and optionally attached to an upper member or other foot-covering member structure), thereby forming a portion of the exterior of the foot-receiving device structure. If desired, the entire interior member may be made from the first material element (e.g., to form an entire bootie structure), optionally with a seamless plantar surface. Alternatively, if desired, the interior member may be made from multiple pieces without departing from the invention, including potentially multiple pieces for any of the heel-surrounding portion, the lateral side portion, the medial side portion, and/or the plantar surface, as well as multiple pieces making up these individual portions.

As another example, a second material element, e.g., including a tongue portion, may be engaged with the first material element to, at least in part, define an instep portion of the foot-receiving chamber. If desired, the entire interior member may be made from only the first and second material elements.

If desired, other portions of the foot-receiving chamber may be made from a double layer of the interior member material (in addition to or in place of the Achilles area portion). For example, either or both of an extended lateral ankle edge portion or an extended medial ankle edge portion (e.g., along the rim of the foot-receiving chamber) may be made from a double layer of the interior member material.

B. Interior Member/Bootie Blanks

Still additional aspects of this invention relate to interior member/bootie blanks, e.g., blanks suitable for making interior member/bootie structures of the various types described above. Such blanks may include a first material element defining: (a) a plantar region, (b) a heel-containing region extending from a first side of the plantar region, the heel-containing region defining a first free end of the bootie blank, (c) a lateral side region extending from a second side of the plantar region, the lateral side region including a lateral side edge extending in a direction toward the heel-containing region, and (d) a medial side region extending from a third side of the plantar region, the medial side region including a medial side edge extending in a direction toward the heel-containing region. The heel-containing region may include a lateral heel edge extending in a direction from the first end toward the lateral side edge and a medial heel edge extending in a direction from the first end toward the medial side edge. The lateral heel and side edges may extend to a location proximate to one another (e.g., to a common point) and define edges to be engaged together when forming a bootie structure (e.g., via a sewn seam, etc.). Similarly, the medial heel and side edges may extend to a location proximate to one another (e.g., to a common point) and define edges to be engaged together when forming a bootie structure (e.g., via a sewn seam, etc.). In accordance with at least some examples of this invention, the first material element includes at least the plantar region, the lateral side region, and the medial side region in a continuous, seamless arrangement.

Bootie blanks in accordance with at least some examples of this invention may include another element, such as a tongue portion. The tongue portion may be included on a second, separate material element, or it may be included as part of the first material element (e.g., optionally formed continuously with either of the lateral or medial side regions, optionally formed continuously with the plantar region, optionally formed on the same material element but discontinuous and/or separated from the plantar region, the heel-containing region, the lateral side region, and the medial side region, etc.). The blanks may be sized and structured to fit any desired footwear or foot-receiving device constructions, such as low top athletic footwear, high top athletic footwear, etc.

Still additional aspects of this invention relate to foot-receiving device interior member blanks that include a first material element defining an extended Achilles area engaging portion for forming a double layer of the material element in an Achilles area when forming a foot-receiving device interior member structure. The first material element also may include one or more of: a plantar region; a heel-containing region contiguous with and extending from a first side of the plantar region, the heel-containing region defining a first end of the blank; a lateral side region contiguous with and extending from a second side of the plantar region; a medial side region contiguous with and extending from a third side of the plantar region; and/or a tongue portion (optionally discontinuous from the plantar region, the heel-containing region, the lateral side region, the medial side region, and/or the extended Achilles area engaging portion on the first material element). Alternatively, if desired, the tongue portion and/or other portions of the blank may be contained on a separate material element from the first material element. The blank may form an overall bootie structure that may be included in an article of footwear or other foot-receiving device structure.

Optionally or alternatively, if desired, the first material element for the blank may be structured so as to provide a double layer of the material element at either or both of an extended lateral ankle area engaging portion or an extended medial ankle area engaging portion (e.g., along the rim of the foot-receiving chamber), with or without the double layer of the material element provided at the Achilles area engaging portion.

The interior member may be formed from any desired material without departing from the invention. In accordance with at least some examples of this invention, at least the first material element of the interior member structure will be constructed from a stretchable material (e.g., stretchable in at least one and preferably multiple directions). The material, in at least some examples, may have at least one non-porous component or layer, e.g., to prevent or inhibit moisture penetration and/or adhesive bleed through, e.g., when the interior member structure is included in a foot-receiving device. If desired, the material element may have a multi-layer structure, including, for example, one or more non-porous layers (such as a batting material layer, etc.), an impact-attenuating layer (such as a foam layer made of polyurethane, ethylvinylacetate, fabric, or other desired material, etc.), one or more fabric materials, and/or other desired layers or materials, and this multi-layered material then may be folded over or otherwise doubled up to provide the double layer of the material element. As still additional examples, the interior member may be a breathable material that allows exhaustion of heat, moisture, and/or air to the exterior, optionally while preventing at least some degree of moisture and/or adhesive transfer from the interior member exterior to its interior.

Bootie blanks of the types described above also may be incorporated into an article of footwear structure without the need to include an additional insole member, sock liner, or the like. The elimination of insole members, sock liners, and the like from the overall footwear structure can be useful to provide a comfortable fit, lower structure, and/or other properties as described above.

C. Impact-Attenuating Elements and Other Foot-Supporting Members

Additional aspects of this invention relate to impact-attenuating elements for foot-receiving devices. Such elements may include: (a) a base member including (e.g., at least partially formed from) an impact-attenuating material, the base member including a front portion, a rear portion, a medial side portion, and a lateral side portion; and (b) a moderator element engaged with the base member, wherein the moderator element includes a first leg member, a second leg member, and a base portion connecting the first and second leg members, wherein each leg member includes a free end located at or toward the front portion of the base member, and each leg member extends from its free end toward the base portion located at or toward the rear portion of the base member with respect to the free ends' locations. In at least some examples, the impact-attenuating elements will provide or form at least a portion of a sole structure (such as a midsole member or a combination midsole/outsole member) for articles of footwear. Such structures including moderator elements of the types described above may help control the flex point of footwear and/or control midfoot torsion.

If desired, additional portions of moderator material may extend between the leg members, e.g., at one or more locations between the free ends and the base portion (e.g., along the arch area to provide additional support). Also, if desired, more than two leg members may be provided and/or one or more of the leg members may have additional branches extending therefrom without departing from this invention.

Impact-attenuating elements in accordance with at least some examples of this invention further may be engaged with other structural elements of a foot-receiving device. For example, the impact-attenuating element may be engaged with a ground-contacting member (such as a footwear outsole structure), a foot-contacting member (such as an insole, an interior bootie element, etc.), a foot-covering member (such as an upper member), a joint covering band or wrap (e.g., a foxing band), a heel counter member, and/or the like.

Moderator elements included in impact-attenuating elements according to the invention may take on any desired form without departing from the invention. In at least some examples, the moderator element will have a thin plate or sheet like structure, e.g., made from fiberglass, plastic (e.g., injected plastic, such as thermoplastic polyurethane), metal, combinations thereof (e.g., 30% glass fiber in nylon 66, etc.), or other suitable material, and it may be attached to an exterior surface of the base member or at least partially included within the base member. In at least some examples, the moderator element will be flexible so as to allow at least some degree of medial-lateral splay and conformance in the forefoot portion (e.g., due to the free ends of the element) and will create an appropriate level of flexibility and/or a flex point at the metatarsophalangeal joint, while also providing at least moderate torsional rigidity and moderated deflection in the heel region (e.g., due to the base portion and its relative stiffness and inflexibility as compared to the stiffness and flexibility characteristics at the free ends).

D. Impact-Attenuating Elements and Foot-Supporting Structures

As noted above, aspects of this invention relate to impact-attenuating elements for foot-receiving device structures, such as midsole structures or other sole structures for articles of footwear. Impact-attenuating elements in accordance with at least some examples of this invention may include: (a) a base member including (e.g., at least partially formed from) an impact-attenuating material, the base member including a front portion, a rear portion, a medial side portion, and a lateral side portion; and (b) an edge element extending from a first surface of the base member, the edge element located along at least a portion of a perimeter of the lateral side portion of the base member (e.g., at and around the fifth metatarsophalangeal joint). This edge element may be structured so as to have sufficient height to engage a lateral side of a foot in use (e.g., to help stabilize the foot and/or maintain it in position with respect to the first surface). If desired, in accordance with at least some examples of this invention, the edge element may be integrally formed as a single piece with the base member (e.g., the edge element may be molded along with the base member as a single piece of material). Also, if desired, a perimeter rim element may be provided around all or substantially all of the base member, and the edge element may be provided in the lateral side portion to extend above at least some portions of the remainder of the perimeter rim element.

Optionally, in at least some example structures, the edge element of the impact-attenuating element may include one or more discontinuity regions along the lateral side portion of the base member (e.g., slits, cuts, gaps, overlapping structures, etc.). Such discontinuity regions may help the impact-attenuating element better bend or flex, conform to foot movements or location changes, etc. Siping or other breaks or discontinuities in the bottom surface or other portions of the base member and/or all the way through the base member (e.g., in generally the longitudinal direction thereof) also may enhance splay and/or conformance of the foot-supporting member to the wearer's foot and/or to the contact surface.

Again, other elements may be included as part of and/or engaged with the impact-attenuating elements without departing from this invention. For example, other elements typically included in an article of footwear or other foot-receiving device structure may be included and/or engaged with the impact-attenuating element without departing from this invention. More specific examples of such elements include: ground-contacting members (which may be engaged with a second surface of the base member opposite the first surface, such as outsole members); heel counter elements; insoles, booties, sock liners, or other foot-contacting or containing members; upper members or other foot-covering members; joint covering elements, such as foxing wraps or bands; etc.

As noted above, ground-contacting members, such as outsole elements, may be included with the impact-attenuating elements described above (e.g., engaged via adhesives, stitching, or the like). Such ground-contacting members may include a perimeter element, e.g., extending from its first major surface, wherein the perimeter element is located at least at a position corresponding to a location of the edge element of the base member and at least partially overlaps and/or contains the edge element of the base member. This joint between the perimeter element and the edge element (and/or optionally the upper member), in at least some examples, may be covered by an additional foxing strip or band member, e.g., extending along at least a portion of the perimeter of the base member that includes the edge element of the base member. The foxing strip also may cover at least a portion of the ground-contacting member, the upper member, a toe cap member, etc.

E. Foot-Supporting Members Including Sole Members for Footwear and Other Foot-Receiving Devices Aspects of this invention relate to foot-supporting members, including ground-contacting members, that may be used in foot-receiving devices (e.g., in sole members, including outsole members, that may be used in articles of footwear). A foot-supporting member (e.g., a sole structure) according to at least some examples of this invention may include: (a) a first major surface including: (i) a plurality of ridge elements extending in a first direction (e.g., a direction extending generally from a lateral side to a medial side of the foot-supporting member structure), and (ii) a plurality of recess regions extending in the first direction, wherein an alternating structure of ridge elements and recess regions is provided in a second direction (e.g., a direction extending generally from a forefoot portion to a rearfoot portion of the foot-supporting member structure); and (b) a second major surface opposite the first major surface, the second major surface including: (i) a plurality of ridge elements extending in the first direction, and (ii) a plurality of recess regions extending in the first direction. In this structure, the ridge elements of the second major surface correspond to a back side of corresponding recess regions of the first major surface, and the recess regions of the second major surface correspond to a back side of corresponding ridge elements of the first major surface. The first and second major surfaces may form the exterior and interior surfaces of a footwear outsole member. Foot-supporting structures of this type can provide very supple shoe/foot and/or shoe/ground interfaces, e.g., with good conformance of the foot-supporting member to the foot and/or ground.

The overall foot-supporting member structure may include other elements as well, such as an impact attenuating material (e.g., a midsole structure), attached to one of the major surfaces of the foot-supporting member. In at least some examples, the first and second major surfaces will be constructed as described above and from a suitable material (e.g., a flexible polymeric material) such that adjacent ridge elements of the first surface splay apart at least somewhat under an applied force in a direction having a component perpendicular to the second major surface (e.g., when a wearer's steps down, changes directions, lands a jump, and/or otherwise applies a force to ridge elements of the second major surface). Application of force with at least a component in the horizontal direction (e.g., or parallel to the contact surface) also may cause splay of some adjacent ridge elements and conformance of the sole structure to the foot and/or ground, in at least some examples of this invention. Also, if desired, portions of the foot-supporting member including the ridge elements and recess regions (e.g., portions of an outsole structure) may be somewhat thinner than other regions of the foot-supporting member structure (e.g., thinner than at least some outsole portions not containing ridge elements and/or recess regions), which can help produce the splay properties described above.

If desired, an impact-attenuating material may be included to at least partially fill at least some of the recess regions of one of the major surfaces (e.g., the unexposed surface to be included in the interior of the foot-receiving device). This impact-attenuating material (e.g., a relatively soft polyurethane) may be somewhat softer than the material making up the first and second major surfaces, and if desired, this material may completely fill the plurality of recess regions of the major surface, e.g., so as to provide a substantially smooth, comfortable, and even major surface.

If desired, in accordance with at least some examples of this invention, the foot-supporting member structure may include a perimeter element extending along at least a portion of a perimeter of the second major surface (e.g., to provide a raised edge or rim around at least a portion of the perimeter). This perimeter element may extend completely around the perimeter of the second major surface, if desired. A midsole member or other impact-attenuating element may be included within the perimeter element. If desired, in accordance with at least some examples of this invention, the perimeter element may include a raised portion along a lateral mid-foot and/or front-foot portion, e.g., near the user's lateral-most toe (e.g., at the fifth metatarsophalangeal joint), which may help to support the lateral side of a user's foot (e.g., particularly during side-to-side motions, direction changes, etc.). The raised portion along the lateral mid-foot and/or front-foot portion may extend somewhat higher than some or all of the remainder of the perimeter element.

In at least some example structures according to the invention, at least some of the ridge elements and at least some of the recess regions of the first major surface will continuously extend essentially completely across the structure, e.g., from the lateral side to the medial side. The term "essentially completely across," as used herein and in this context, means that the ridge elements and recess regions extend across at least 75% of the structure in a given direction (e.g., from the lateral side to the medial side), and in some examples it will extend at least 90% of this distance. The ridge elements and recess regions of the first major surface may have a zig-zag structure in the first direction and/or at least some of the ridge elements and the recess regions of the first major surface may produce a herringbone pattern. Optionally, the herringbone pattern, when present, may cover a majority of the first major surface (e.g., at least 50% of the major surface area, and in some more specific examples, at least 75% or 90% of the major surface area).

F. Combinations of Features

Additional aspects of this invention relate to combinations of two or more of the various features, components, and/or aspects of the invention described above. Such combinations may include, for example, two or more of: (a) an interior member and/or upper member structure with a continuous and/or seamless plantar region, (b) an interior member structure with a double layer of material at the Achilles-engaging portion (and optionally other areas), (c) an impact-attenuating member with a moderator element included therein, (d) an impact-attenuating member with an additional lateral support structure, (e) a contact surface-contacting member with an additional lateral support structure, (f) a contact surface-contacting member with ridge and recess regions, and/or (g) an upper member, e.g., of a substantially unstretchable material. The various features, components, and/or aspects of the invention described above further may be provided in combination with other features, elements, and components, such as features, elements, and/or components provided in conventional footwear structures.

G. Foot-Receiving Device Structures

Still additional aspects of this invention relate to foot-receiving device structures (such as articles of footwear) that include one or more of the various components, features, and/or aspects of the invention described above. As one example, such foot-receiving devices may include: (a) an interior member/bootie element defining a foot-receiving chamber, the interior member/bootie element including a first material element having a heel-surrounding portion, a lateral side portion, a medial side portion, and a seamless plantar surface, wherein the first material element includes the plantar portion, the heel-surrounding portion, the lateral side portion, and the medial side portion in a continuous, one-piece arrangement; and (b) a first foot-receiving device component engaged with the interior member/bootie element. Optionally, if desired, the interior member/bootie element further may include a tongue portion, e.g., optionally formed from the first material element or from a second material element engaged with the first material element. The tongue portion may at least partially define an instep portion of the foot-receiving chamber.

Still additional aspects of this invention relate to foot-receiving device structures (such as articles of footwear) that include: (a) an interior member at least partially defining a foot-receiving chamber, the interior member including a first material element having a double layer of the material element along an Achilles area portion; and (b) a first foot-receiving device component engaged with the interior member. The first material element making up the interior member (which may be made from a stretchable, soft fabric or foam material) further may include one or more of a heel-surrounding portion, a lateral side portion, a medial side portion, a plantar surface, an ankle-containing portion, a tongue portion, etc. Alternatively, if desired, at least some portion of the tongue may be provided as a second material element engaged with the first material element, e.g., at an instep portion of the foot-receiving chamber, along the lateral, medial, or plantar portions, etc. Additionally or alternatively, as described above, a double layer of the interior member material may be provided along an extended lateral or medial ankle edge portion of the foot-receiving chamber (e.g., along a rim of the foot-receiving chamber).

The first foot-receiving device component engaged with the interior members/bootie elements described above may take on a wide variety of different forms without departing from this invention. As some more specific examples, this first foot-receiving device component may include: a tongue cover element; at least a portion of a sole member for an article of footwear (such as a portion of a midsole member); at least a portion of an upper member for an article of footwear (e.g., an unstretchable or substantially unstretchable material, such as a canvas or leather material (e.g., less than 30% stretch in any direction, and optionally less than 15% stretch in any direction), forming a major portion of the upper member, etc.); a heel counter; an impact-attenuating material (such as a polyurethane foam material); another type of foot-supporting member element; another type of foot-covering member element; etc. Also, multiple foot-receiving device components may be engaged with the interior member/bootie element, directly or indirectly, with any desired piece thereof (if multiple pieces are present), without departing from the invention.

Still additional aspects of this invention relate to foot-receiving devices, including articles of footwear, that include impact-attenuating elements or other foot-supporting members, e.g., of the various types described above (such as sole members, including midsole elements or midsole/outsole combination members). Foot-receiving devices (e.g., articles of footwear) according to at least some examples of this invention may include: (a) a foot-covering member (such as an upper member); and (b) a foot-supporting member engaged with the foot-covering member (such as a midsole member or other sole structure) that includes: (i) a base member including an impact-attenuating material, the base member including a front portion, a rear portion, a medial side portion, and a lateral side portion; and (ii) a moderator element engaged with the base member. The moderator element may take on the various structures described above, such as it may include at least a first leg member, a second leg member, and a base portion connecting the first and second leg members, wherein each leg member includes a free end located at or toward the front portion of the base member, and each leg member extends from its free end toward the base portion located at or toward the rear portion of the base member as compared with the free ends' locations. As noted above, the moderator element may include additional elements, such as additional leg members, branches from one or more of the leg members, additional elements or portions connecting the leg members, etc. The moderator element may be engaged with or included within the base member (partially or completely within) without departing from this invention. The overall foot-receiving device structure further may include a ground-contacting element, such as an outsole member, a foot-contacting member (such as a bootie element or an insole member), a heel counter, a foxing wrap or band, a toe cap, and/or other footwear features without departing from this invention.

Additional aspects of this invention relate to foot-receiving devices, such as articles of footwear, that include: (a) a foot-covering member (such as an upper member); and (b) a foot-supporting member (such as a sole structure or a portion of a sole structure) directly or indirectly engaged with the foot-covering member that includes: (i) a base member including an impact-attenuating material, the base member including a front portion, a rear portion, a medial side portion, and a lateral side portion; and (ii) an edge element extending from a first surface of the base member, the edge element located along at least a portion of a perimeter of the lateral side portion of the base member, wherein the edge element has sufficient height to engage (e.g., support, contain, abut against, prevent the movement of, etc.) a lateral side of a foot in use (e.g., at the fifth metatarsophalangeal joint). If desired, the foot-supporting member may include at least a midsole member for an article of footwear. The foot-supporting member further may include one or more of: a ground-contacting member, such as an outsole member; a foot-contacting member, such as an insole member, sock liner, or a bootie element; a heel counter; a foxing band or wrap; etc. The ground-contacting member may include an edge element having sufficient height to engage (e.g., support, contain, abut against, prevent movement of, etc.) the edge element of the base member and/or the lateral side of a user's foot.

Additional aspects of this invention relate to foot-receiving devices, such as articles of footwear, that include: (a) a foot-covering member (such as an upper member for an article of footwear); and (b) a foot-supporting member (such as a sole member for an article of footwear) engaged with the foot-covering member, wherein the foot-supporting member includes a ground-contacting member (such as an outsole member for an article of footwear). The ground-contacting member may include: (a) an exposed first major surface including: (i) a plurality of ridge elements extending in a first direction (e.g., in a direction extending generally from a lateral side to a medial side of the foot-supporting member), and (ii) a plurality of recess regions extending in the first direction, wherein an alternating structure of ridge elements and recess regions is provided in a second direction (e.g., in a direction extending generally from a forefoot portion to a rearfoot portion of the foot-supporting member); and (b) a second major surface opposite the first major surface, the second major surface including: (i) a plurality of ridge elements extending in the first direction, and (ii) a plurality of recess regions extending in the first direction. In this structure, the ridge elements of the second major surface correspond to a back side of corresponding recess regions of the first major surface and the recess regions of the second major surface correspond to a back side of corresponding ridge elements of the first major surface. This foot-supporting member may provide a supple shoe/foot and/or shoe/ground interface and have excellent conformance to a user's foot and/or to the ground.

Foot-receiving devices according to the invention may take on any desired form or structure. For example, the foot-covering member (e.g., the upper member) may be made of any desired materials, including one or more of: leathers (natural or synthetic); rubbers (natural or synthetic); polymers; fabrics (canvas materials); substantially unstretchable materials (e.g., less than 30% stretch in any direction, and optionally less than 15% stretch in any direction); and the like. The foot-receiving device may have a "high top" type construction (e.g., including an upper member having an ankle-covering portion), a "low top" type construction (e.g., including an upper member that leaves at least some portion of the ankle exposed), etc. Any type of footwear may take advantage of various aspects of this invention, including, for example, athletic footwear, such as sneakers, basketball shoes, and the like.

Foot-receiving device structures according to the invention also may include combinations of two or more of the various features, components, and/or aspects described above.

Given the general description of various examples and aspects of the invention provided above, more detailed descriptions of specific examples of components, features, and aspects of the invention are provided below.

III. Specific Examples of Interior Members and Foot-Receiving Devices According to the Invention

A. General Overview of Example Finished Products

Figure 1B:
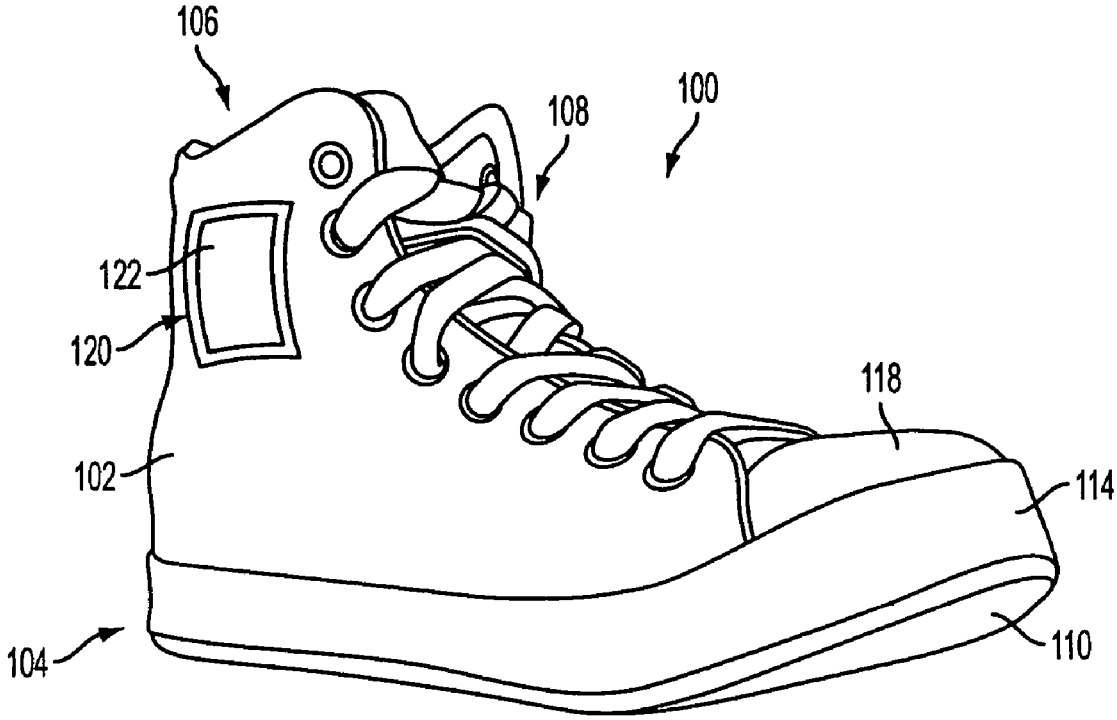
Figure 1C:
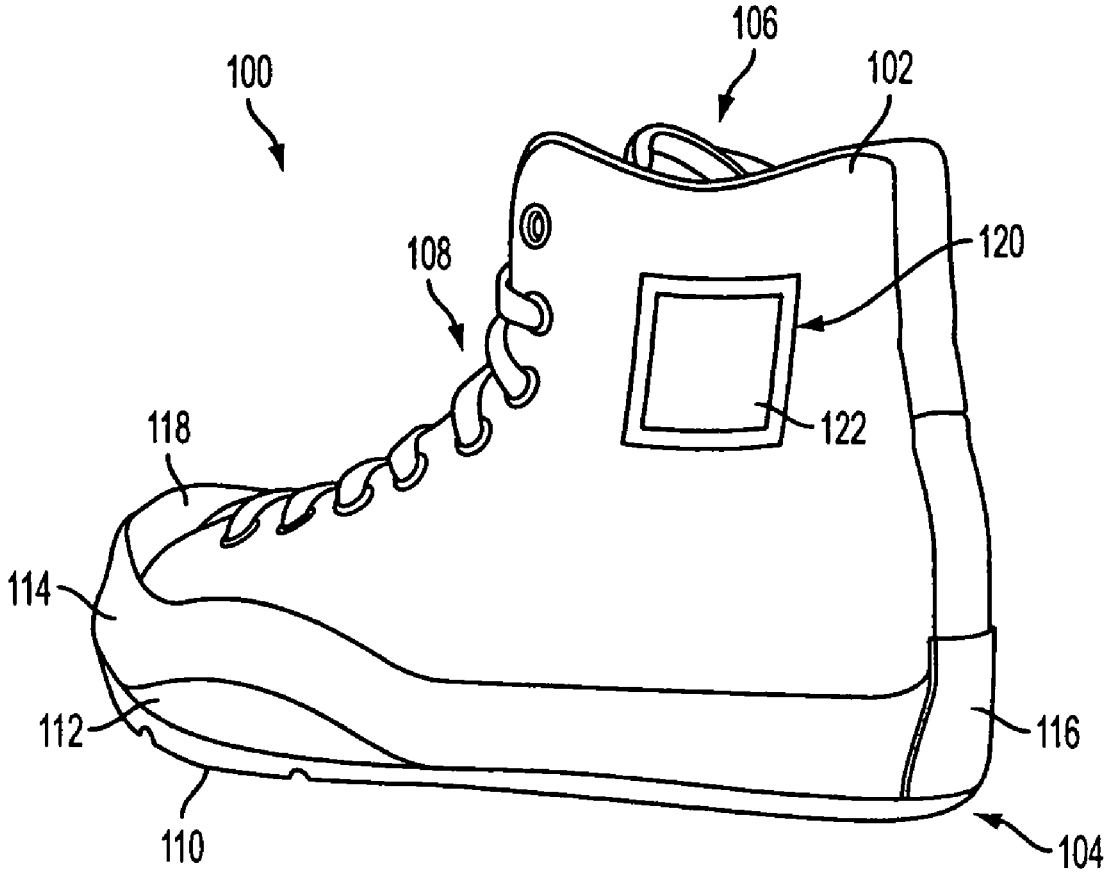

FIGS. 1A through 1C illustrate an example article of footwear 100 according to at least some examples of this invention. As shown, the article of footwear 100 includes an upper member 102 and a sole structure 104. The upper member 102 includes a foot-receiving opening 106 defined therein. While the upper member 102 may be made from any desired material(s) and in any desired construction without departing from the invention (including from conventional materials and conventional constructions known and used in the art), in this illustrated example, the upper member 102 is constructed primarily from a fabric material (e.g., a canvas material) having a relatively low degree of stretchability (or is substantially unstretchable), and it is constructed as a high top (e.g., ankle covering) article of athletic footwear. The term "unstretchable" as used herein in this context and unless otherwise indicated, means the material has less than 30% stretch in any direction as measured by ASTM D5035. Optionally, if desired, the material for the upper may have a stretchability of less than 15%, or even less than 10%, without departing from this invention. Of course, other types of footwear utilizing other upper materials (such as one or more of leathers, polymeric materials, other fabrics, etc.) may be produced without departing from the invention. Also, if desired, an upper material may be constructed by attaching a stretchable material to an unstretchable backing or other material, such that the composite material has the desired level of unstretchability, without departing from this invention.

The upper member 102 of this illustrated example structure 100 further includes a closure system 108 to assist in holding the article of footwear 100 on a user's foot. While the closure system 108 in this example article of footwear 100 includes a conventional shoe lace and eyelet system, other closure systems may be used without departing from the invention, including, for example, known and/or conventional closure systems, such as hook-and-loop fasteners, straps, buckles, zippers, elastic bands or members, and the like.

The upper member 102 is attached to the sole structure 104 in this example structure. Any desired type of connection between the upper member 102 and the sole structure 104 may be used without departing from the invention, including conventional connections known and used in the art (such as adhesives, stitching, and the like). More specific examples of this connection for this illustrated footwear structure 100 will be described in more detail below in this specification. The sole structure 104 of this example, which also will be described in more detail below, includes an outsole member 110 for contacting the ground or other surface in use. As shown in FIGS. 1A and 1C, and as will be described in more detail below, the sole structure 104 of this example arrangement further includes a raised lateral edge or perimeter member 112, which may be integrally formed along the outsole 110 perimeter (e.g., at least in the lateral forefoot and/or midfoot area, in the fifth metatarsophalangeal area, etc.). The outsole member 110, optionally including the perimeter member 112, may be formed from any desired materials without departing from this invention, including from conventional outsole materials known and used in the art, such as rubber (natural or synthetic), polymeric materials, leathers, and/or combinations thereof. If desired, a relatively soft synthetic rubber material may be used to provide good traction and a supple interface between the sole and the contact surface.

The junction between the upper member 102 and the sole structure 104 in this illustrated example structure 100 is covered by a foxing band 114. In this example structure 100, the foxing band 114 extends substantially around the entire perimeter of the shoe structure 100. The foxing band 114, which may be made from any desired number of independent pieces, may be of any desired width (including of a varying width), and it may be applied over and held to the upper member 102 and/or the sole structure 104 in any desired manner without departing from the invention, such as via adhesives, cements, stitching, or the like. The foxing band 114 may be formed of rubber (synthetic or natural), polymeric materials (such as thermoplastic polyurethane), or other desired materials. In this illustrated example structure 100, the free ends of the foxing band 114 are covered and held in place by an upwardly extending portion 116 of the sole structure 104, right at the rear heel area of the shoe structure 100. Of course, other ways of securing the foxing band 114 in place (when one is present) may be used without departing from this invention.

As shown in FIGS. 1A and 1C, in this example structure 100, the foxing band 114 extends along and over the edge of perimeter member 112 of the outsole structure. Of course, this is not a requirement. For example, if desired, the foxing band 114 also could cover the perimeter member 112. As still another example, if desired, the foxing band 114 could maintain a single constant level along the lateral side of the shoe 100, appearing similar to the way it appears on the medial side (as shown in FIG. 1B). As still additional alternatives, if desired, the foxing band 114 may be provided along less than the entire perimeter, optionally in multiple discrete portions or parts, without departing from this invention. Further still, if desired, the independent foxing band 114 may be omitted and/or it may be integrally formed as part of the outsole structure 110 (e.g., by providing a "cup"-type outsole member in which the open, upper perimeter portion of the outsole member forms a band that appears similar to and/or functions similar to the foxing band 114).

The front portion of the foxing band 114 in this example footwear structure 100 extends around the front toe portion of the shoe 100, and it may provide additional wear resistance in this area. Additionally, the foxing band 114 of this illustrated example structure 100 extends over and at least partially helps secure a toe cap 118 over the front of the upper member 102. The toe cap 118 may be used to provide additional wear resistance in this front area of the shoe 100, which can be exposed to substantial bending, scraping, or scuffing forces in use. The toe cap 118 may be attached to the remainder of the footwear structure 100 in any desired manner and the foxing band 114 may be attached over a portion of the toe cap 118 in any desired manner, such as via adhesives, stitching, and the like.

As still another feature, if desired, the upper member material may have one or more discontinuities in it, like open regions 120 provided on one or both sides of the upper member 102 at the ankle area. These open regions 120 may be covered or filled with one or more layers of bootie material 122, as will be described in more detail below. Providing an opening or discontinuity in this ankle area can provide a more comfortable and/or dynamic fit, e.g., as compared with covering the ankle completely with upper member material (e.g., a generally stiff or unstretchable material that may cause irritation, undesirable folding or buckling, etc.).

Given this general overview of example footwear structures according to the invention, a more detailed description of various parts, components, and aspects of the invention follows.

B. Example Bootie Structures

The interior (or "foot-receiving chamber") of articles of footwear or other foot-receiving devices can take on a wide variety of different constructions without departing from this invention. For example, if desired, in the example structure 100 shown in FIGS. 1A through 1C, the interior chamber may include a comfort-enhancing insole member or sock liner at the footbed bottom, and the remainder of the user's foot may be directly exposed to the inside surface of the material making up the upper member 102.

Alternatively, in accordance with at least some examples of this invention, the foot-receiving chamber of the upper member 102 may have an interior member or "bootie" structure included therein. This bootie member may be made, for example, of a soft, comfort-enhancing material. This bootie member may comprise any desired number of pieces (e.g., separate pieces, pieces sewn or otherwise engaged together, etc.), and it may partially or completely fill the interior volume of the upper member 102.

Figure 2:
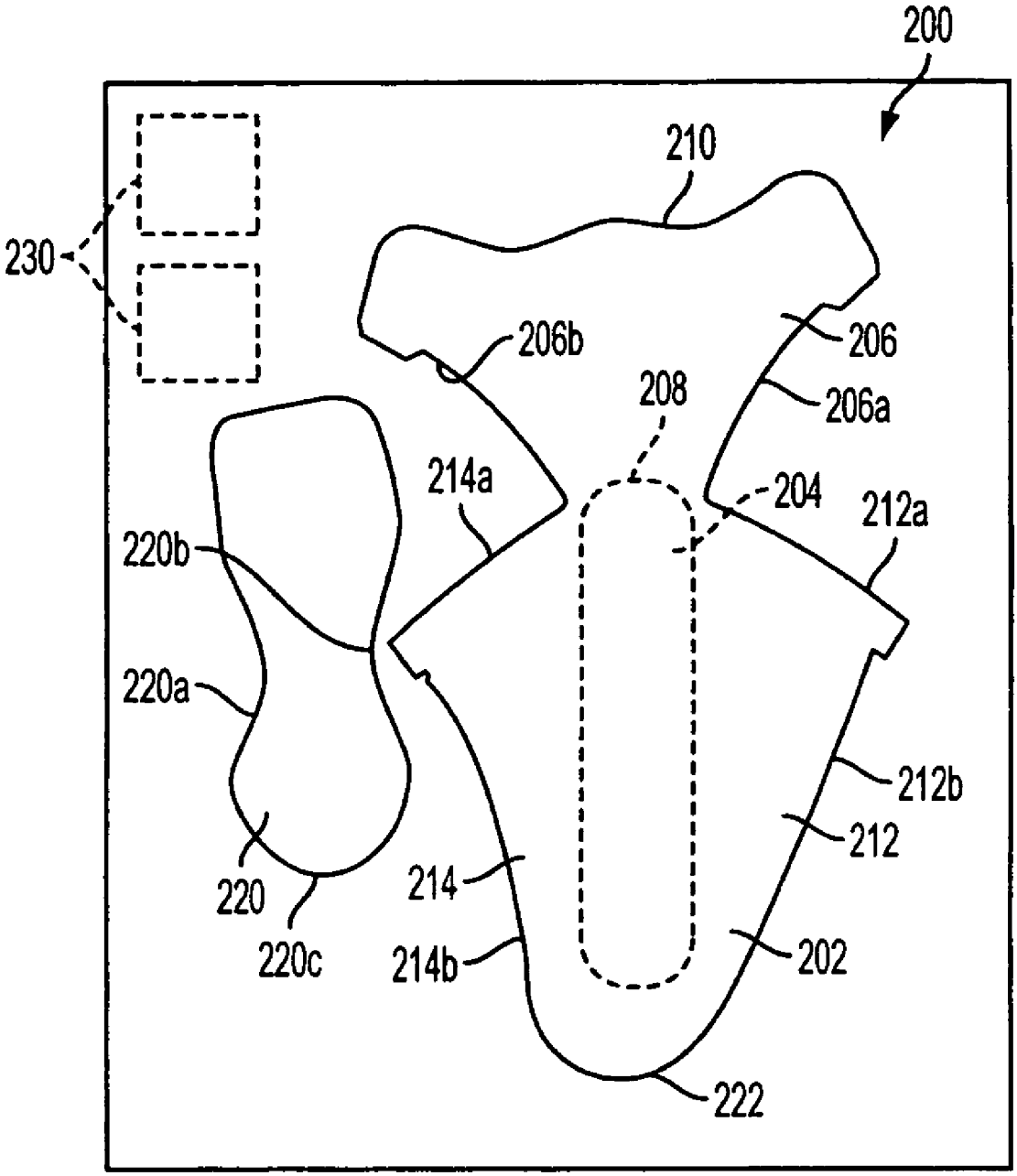
FIG. 2 illustrates an example bootie blank member that may be used in foot-receiving device products in accordance with at least some examples of this invention.

FIG. 2 illustrates an example bootie blank 200 to make bootie structures for articles of footwear, e.g., for use in footwear of the types illustrated in FIGS. 1A through 1C. This example bootie blank 200 includes two independent parts that may or may not be provided on the same piece of fabric, namely a first material element 202 defining a plantar region 204 and a heel-containing region 206 (e.g., extending from a first side 208 of the plantar region 204). The heel-containing region 206 of this example defines a free rear end 210 of this piece 202 of the bootie blank 200. A lateral side region 212 extends from a lateral side of the plantar region 204, and a medial side region 214 extends from a medial side of the plantar region 204. The lateral side region 212 includes a lateral side edge 212*a* extending in a direction toward the heel-containing region 206, and the medial side region 214 includes a medial side edge 214*a* extending in a direction toward the heel-containing region 206, as shown in FIG. 2. As also shown in FIG. 2, the first material element 202 of this example includes the plantar region 204, the heel-containing region 206, the lateral side region 212, and the medial side region 214 in a continuous, one-piece, seamless arrangement.

The heel-containing region 206 of this example bootie blank structure 200 includes a lateral heel edge 206*a* extending in a direction from the rear end 210 toward the lateral side edge 212*a* such that the lateral heel edge 206*a* and the lateral side edge 212*a* extend and terminate proximate to one another (e.g., at a common point) and define edges to be engaged together when forming the bootie structure. Similarly, in this example structure 200, the heel-containing region 206 includes a medial heel edge 206*b* extending in a direction from the rear end 210 toward the medial side edge 214*a* such that the medial heel edge 206*b* and the medial side edge 214*a* extend and terminate proximate to one another (e.g., at a common point) and define edges to be engaged together when forming the bootie structure.

The bootie blank 200 of this example structure includes a second part, which may be on the same or a different physical material element from that including the first material element 202. As illustrated, this second part includes a tongue portion 220. A lateral edge 220*a* of the tongue portion 220 may be joined (e.g., by sewing) to at least a portion of a second lateral side edge 212*b* of the first material element 202, and/or a medial edge 220*b* of the tongue portion 220 may be joined (e.g., by sewing) to at least a portion of a second medial edge 214*b* of the first material element 202, to form the overall bootie structure. Additionally or alternatively, the front edge 220*c* of the tongue portion 220 may be joined (e.g., by sewing) to the front edge 222 of the first material element 202 when the overall bootie structure is formed. As still another alternative, if desired, the tongue portion 220 may be continuously formed with at least one portion of the first material element 202 (e.g., with the edges 212*b*, 214*b*, and/or 222) such that at least some of the sewing steps and/or seams can be eliminated.

If desired, at least one surface of the bootie materials 202 and/or 220 may include printed matter, and when the bootie is formed, this printed matter may be visible in the final footwear structure (e.g., as the bootie interior, through an opening provided in the upper member, etc.).

This example bootie blank 200 further includes additional patch elements 230, that may be used to provide a double layer of the bootie material over one or more openings 120 provided in the upper member 102, as shown in FIGS. 1A through 1C. Of course, if desired, the patch elements 230 may be provided on a separate piece of material from the remainder of the bootie blank 200 and/or it may contain different colors, different printing, etc. The additional layer of bootie material, e.g., at this illustrated ankle area, can provide a more comfortable and/or dynamic fit, e.g., as compared to completely covering this ankle area with upper material (e.g., which tend to be relatively stiff and/or unstretchable materials).

Figure 3:
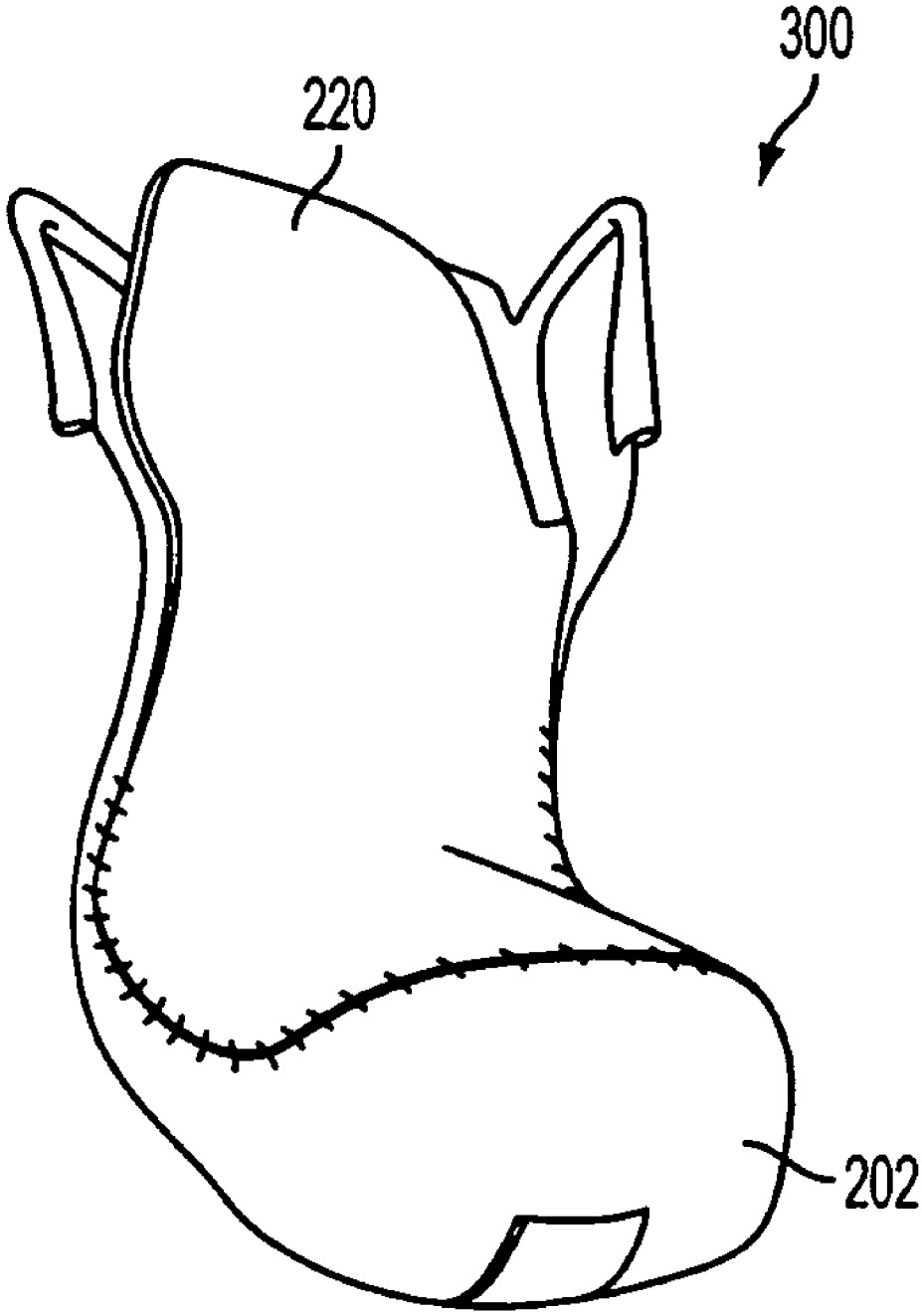
FIG. 3 illustrates the example bootie blank of FIG. 2 folded and sewn together.

FIG. 3 illustrates an example of an assembled bootie structure 300 using the bootie blank 200 described above in conjunction with FIG. 2. As shown, the various pieces 202 and 220 of the bootie blank 200 are cut out, and the various edges and pieces of the bootie structure 300 are held together, in this example, by sewing. In this arrangement 300, as shown, the plantar and side edge portions (both medial and lateral sides) of the bootie structure 300 do not include any seams, thereby providing a very comfortable foot-contacting member (e.g., seams generally are at the top or instep portion of the foot and/or along the ankle or heel sides). Notably, although not a requirement, the bootie structure 300 of this example includes an ankle-covering or containing portion, e.g., the bootie extends high enough to cover the wearer's ankle and is suitable for use as part of a high-top footwear or other foot-receiving device construction.

Figure 4A:
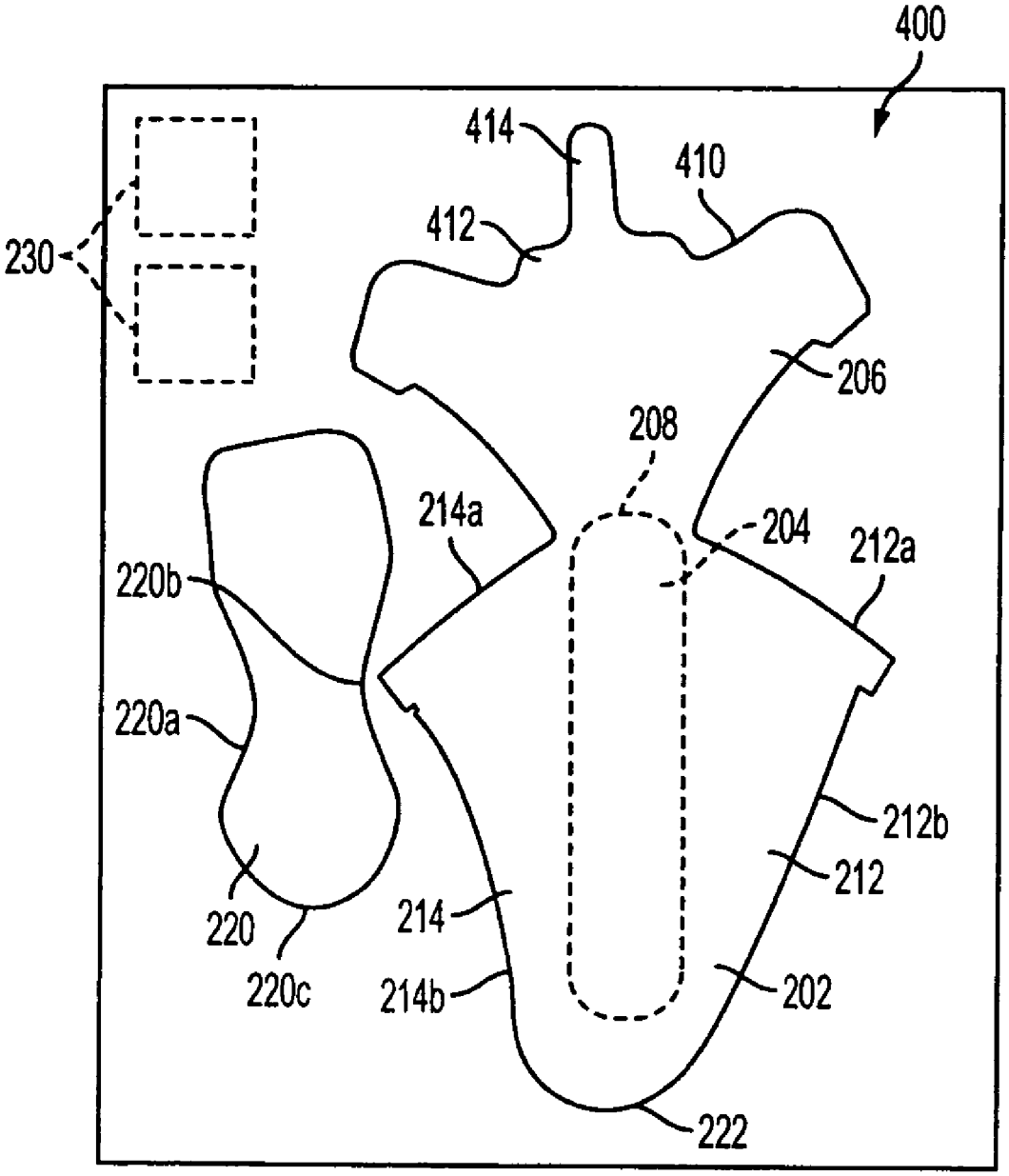
FIGS. 4A and 4B illustrate additional examples of bootie blank members that may be used in foot-receiving device products in accordance with at least some examples of this invention.

FIG. 4A illustrates another example of a bootie blank structure 400 that may be used in accordance with at least some examples of this invention. In this illustrated example structure 400, parts that are the same as or similar to those described above in conjunction with FIG. 2 are identified using the same reference numbers (and the redundant description is omitted). The main difference with this example structure 400 lies at the rear edge 410 of the heel-containing portion 206 of the bootie blank structure 400. Specifically, as shown, the rear edge 410 of this structure 400 includes a rim extending portion 412 and an extended Achilles engaging portion 414. When provided, these additional portions of the bootie blank 400 provide a double layer of bootie material along an increased portion of the upper member 102, e.g., at the upper rear edges of the shoe rim near the ankle and/or along some or all of the entire length of the Achilles. In the bootie construction, the upper rim of the bootie may be formed by folding the rear edge 410 over and sewing it (optionally to a portion of an upper member), thereby providing a double layer of bootie material along the rim (or at least portions of it) by material 412 and/or down the Achilles area by material 414. No reinforcement material (or other additional material) need be provided along with or between these double layers of material, although a fabric or other backing material may be provided, if desired. Of course, either of extended regions 412 or 414 may be omitted from a given structure without departing from the invention, as shown in the example structure 200 of FIG. 2. Also, either of these extended regions 412 and/or 414 may extend any desired distance and may be exposed along the shoe exterior by any desired amount in the final footwear product without departing from this invention.

Figure 4B:
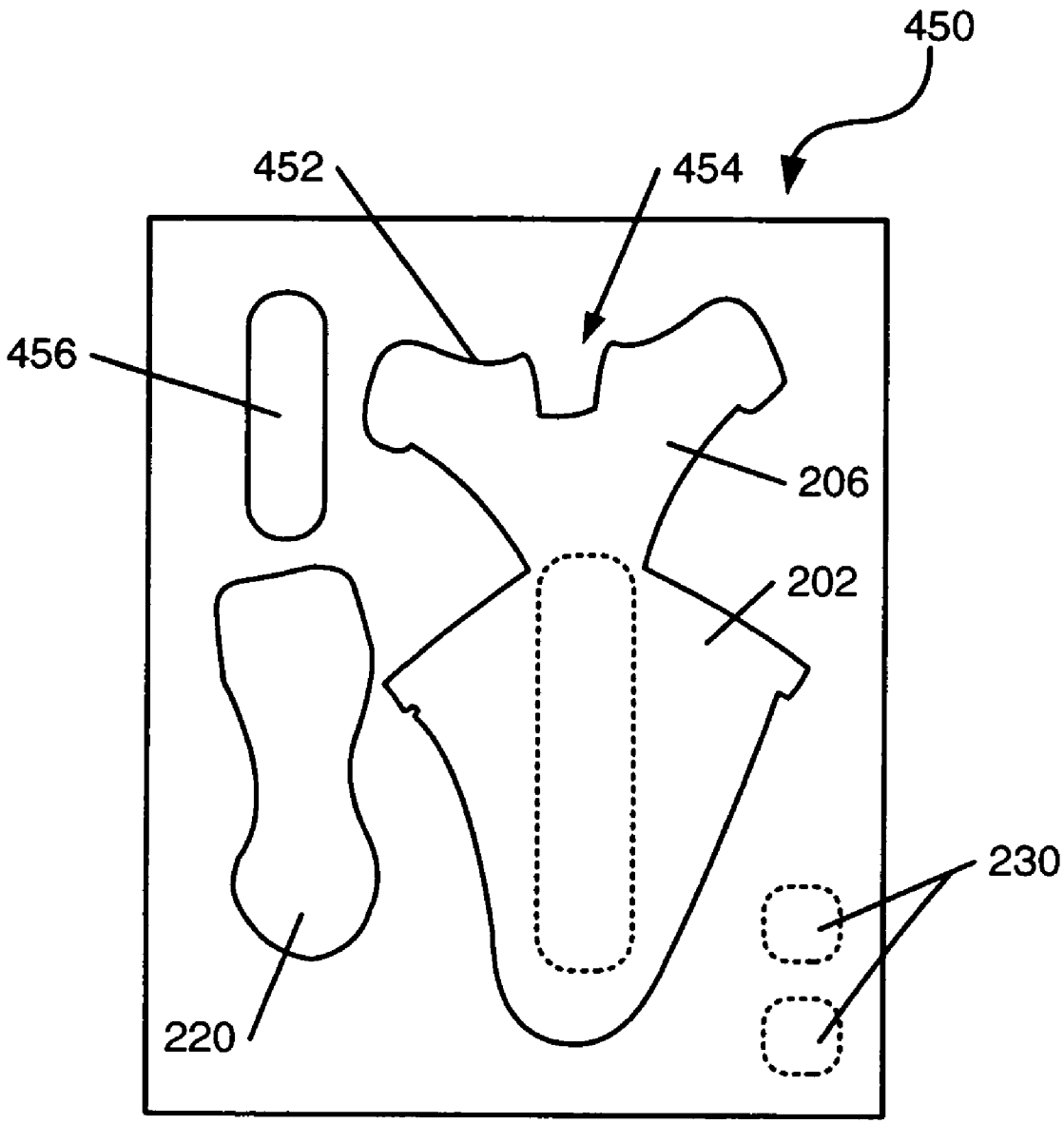

Alternatively, as shown in the example bootie blank 450 of FIG. 4B, the double layer of bootie material may be provided as an additional separate piece of bootie material 456 from the heel-containing portion 206. During bootie and/or shoe construction, the bootie material piece 456 may be folded over and sewn into the overall structure, e.g., at a notch area 454 provided in the rear edge 452 of the heel-containing portion 206. Of course, if desired, the notch 454 may be omitted and a single or double layer of bootie material 456 (or more) may be sewn into the overall bootie or upper member structure at the desired location (e.g., during bootie construction, as part of attachment of the bootie to the upper member, during construction, etc.). Also, if desired, fabric or other backing material may be provided in the Achilles area.

The double layer of bootie material provided by extending portions 412, 414, and/or 456 can further enhance the comfort of the footwear (e.g., by providing soft, flexible, non-stiff material at these flexing and/or contacting points, e.g., as compared with the material of the upper member 102). Additionally, the presence of the bootie material at these locations can be more aesthetically pleasing when the materials flex during use (e.g., the material of the upper member 102 can be rather stiff and can tend to bunch up and/or fold up undesirably when flexed during use as compared with the bootie material).

The bootie blanks and the overall bootie structures may be made from any desired number of individual pieces and/or any desired types of materials without departing from the invention, including, for example, from conventional fabric and/or foam materials known and used in the art (such as knit fabrics, cotton fabrics, synthetic fabrics, polyurethane foams, etc.). In accordance with at least some examples of the invention, one or more layers of the material making up the bootie structure may be at least somewhat impermeable in at least one direction, e.g., to prevent or inhibit adhesives or other materials from passing from the exterior into the bootie interior. In accordance with at least some examples, the bootie may have an intermediate layer of soft flexible fabric material with one or more outer layers of batting or other at least somewhat impermeable material. In at least some examples, the bootie material will be breathable, to allow moisture, air, and/or heat to escape from the bootie interior. Alternatively, if desired, vent openings and/or other vent structures (such as eyelets, slits, slots, or other openings) may be provided in the bootie structure without departing from the invention.

C. Example Bootie/Upper Structures

Bootie structures 200, 400, and/or 450 of the types described above may be engaged with or contained in footwear upper members (and/or foot-covering members for other foot-receiving device products). As mentioned above, upper structures used in footwear (or foot-covering members for other foot-receiving devices) in accordance with this invention may take on a variety of different structures and constructions, and they may be made from a wide variety of materials (or combinations of materials) without departing from the invention, such as leathers, polymeric materials, fabric materials, canvas materials, and the like. The upper structure also may be made from any desired number of independent pieces of material without departing from the invention.

Figure 5:
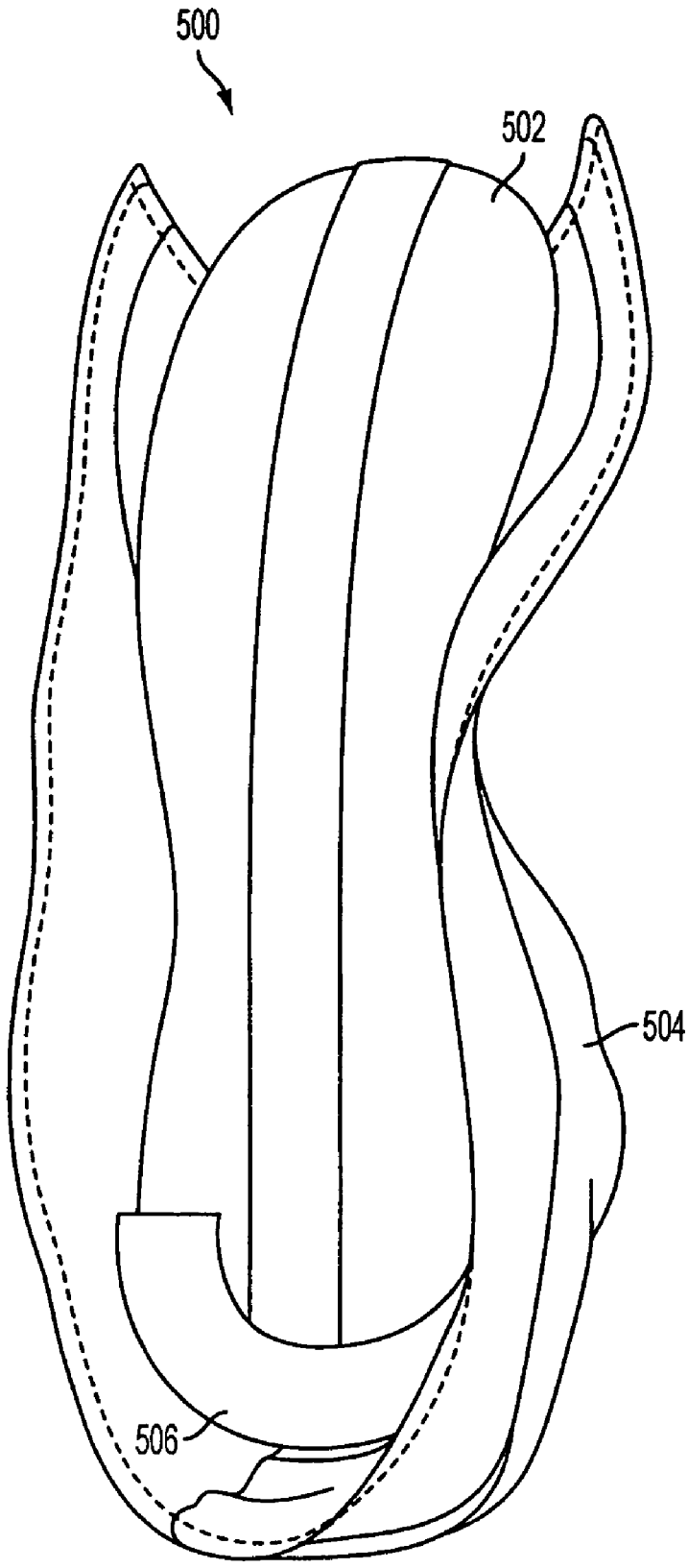
FIG. 5 illustrates an example bootie structure and upper member combination that may be used in products in accordance with at least some examples of this invention.

FIG. 5 illustrates an example structure 500 including a formed bootie member 502 (e.g., of the types described above in conjunction with FIGS. 2-4B) engaged with at least one portion of an upper member 504. While the bootie member 502 and the upper member 504 may be engaged with one another in any desired manner without departing from this invention, in this illustrated example, the bootie member 502 is sewn to the upper member 504, e.g., along stitch lines provided around the top rim (e.g., at the foot-receiving opening), along the lace eyelet area, along the tongue or front of the tongue, etc. Furthermore, if desired, a tongue cover element may be provided, e.g., covering the tongue portion of the bootie 502, sewn to the tongue portion of the bootie 502, etc. Alternatively, if desired, the tongue portion of the bootie may be omitted and a separate tongue element may be provided, e.g., along with or part of the upper member 504.

If desired, at this point in the construction, the bottom of the bootie element 502 (e.g., including the footbed or plantar surface) may remain relatively free and unattached, e.g., from the upper member 504. If desired, a heel counter element 506 may be attached to the heel area of the bootie member 502 (e.g., adhered directly to the exterior surface of the bootie member 502 via an adhesive, optionally with an intermediate foam or other impact-attenuating layer between the counter 506 and the bootie member 502, etc.). The heel counter element 506, when present, may be a thin element (e.g., made from thermoplastic polyurethane, plastic, or other suitable material having a relatively moderate stiffness (e.g., it remains relatively flexible)) that provides support for the heel and some structural rigidity to the overall footwear structure (e.g., particularly to the upper member 504 and bootie 502 when these members are made from relatively flexible materials, such as canvas and/or other fabrics), while still allowing the upper member 504 and footwear structure to conform to the wearer's foot.

The heel counter member 506, when present, may be directly bonded to the bootie member 502, e.g., via adhesive. In this manner, no additional structural elements are located between the heel counter 506 and the bootie member 502 (e.g., in many conventional athletic footwear structures, heel counters may be quite stiff and/or included as one layer in a multi-layer upper member structure). This feature enables the counter member 506 to have close contact with, and optionally wrap around, a portion of the wearer's foot. As illustrated in FIG. 5, in this illustrated example structure, the heel counter member 506 at least partially wraps around the sides and bottom portion of the wearer's heel.

As described above in conjunction with FIGS. 4A and 4B, in at least some example structures, portions of the foot-receiving opening rim and/or the Achilles area of the footwear structure may include a double layer of the bootie material at the rear heel area, e.g., to provide additional flexibility, better aesthetic appearance, and/or more comfort during use (e.g., during bending, etc.). If necessary and desired, additional seams or stitching may be provided in these bootie material double layer areas, e.g., to maintain structural integrity, to hold the various parts together, to prevent fraying, to hold the bootie member to the upper member, etc. Additional stitching also may be provided around any openings in the upper member, e.g., where bootie material is exposed through openings 120 defined in the upper member in FIGS. 1A through 1C. If desired, one or more additional layers of bootie material 122, 230 may be sewn in and/or around these upper member openings 120. Also, sewing, adhesives, or other structural elements may be provided, if necessary and/or desired, at any other locations in the upper member 504 and/or bootie member 502 structures without departing from this invention, e.g., to engage these members together.

D. Example Outsole Structures

Any outsole structure may be used on various articles of footwear without departing from this invention, and these outsoles may have any desired constructions, any desired tread design, and may be made from any desired materials without departing from the invention (including conventional constructions, tread designs, and materials known and used in the footwear art).

Figure 6A:
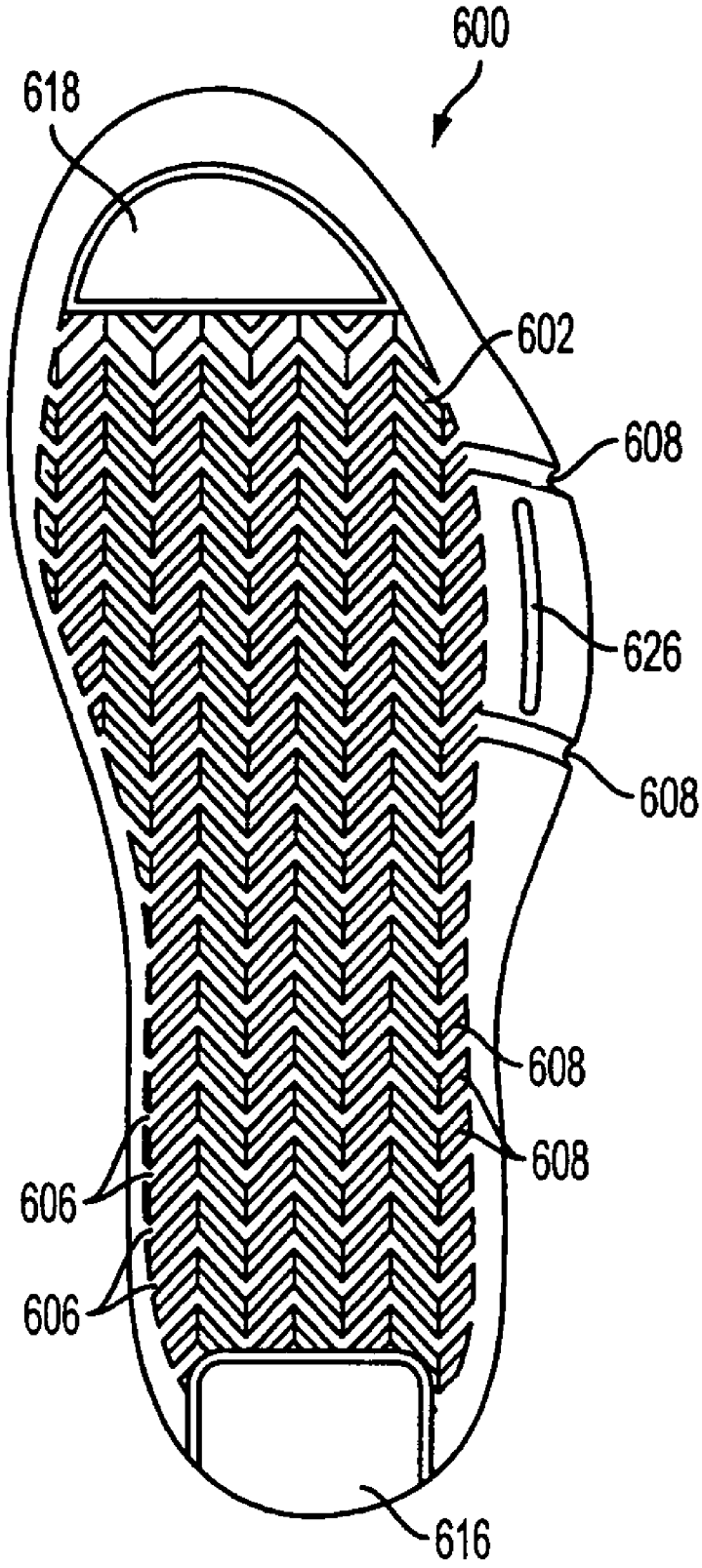
FIGS. 6A through 6D illustrate various views of an example outsole structure that may be used in products in accordance with at least some examples of this invention.
Figure 6B:
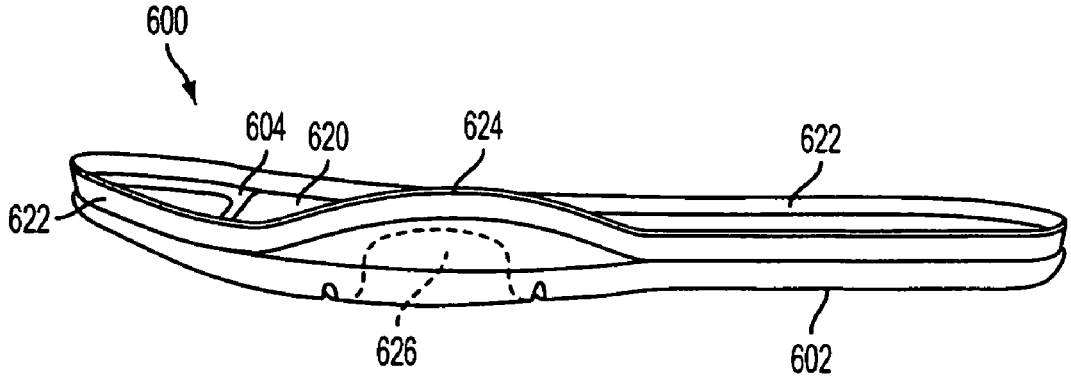
Figure 6C:
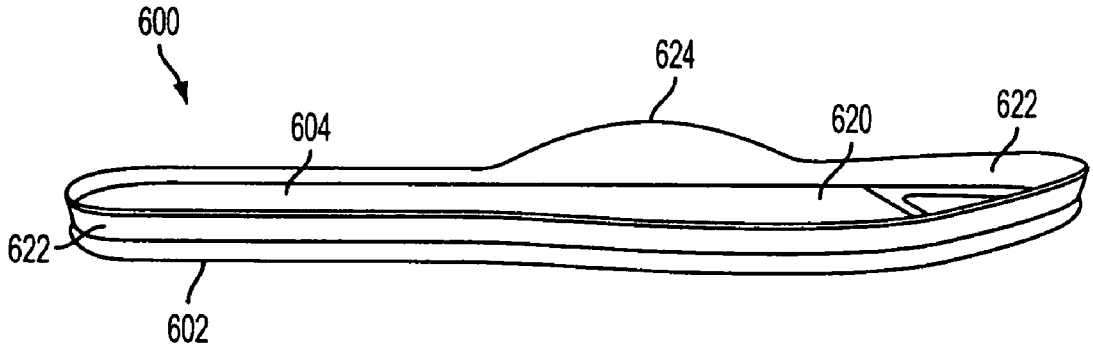
Figure 6D:
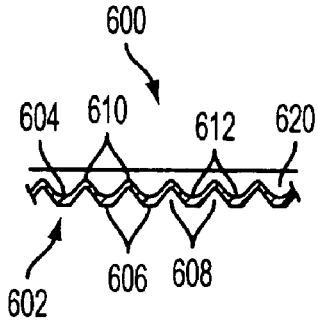

FIGS. 6A through 6D, however, illustrate examples and features of outsole (or other ground-contacting) structures 600 that may be used in articles of footwear (or other foot-receiving devices) in accordance with at least some examples of this invention. As shown in these figures, the outsole structure 600 includes a first major surface 602 (e.g., designed to contact the ground or other surface in use) and a second major surface 604 opposite the first surface 602 (e.g., designed to support the foot and be located in the footwear interior). As shown in FIG. 6A, the first major surface 602 may include a plurality of ridge elements 606 generally extending in a direction from a lateral side to a medial side of the sole structure 600, and a plurality of recess regions 608 generally extending in the direction from the lateral side to the medial side. Likewise, the second major surface 604 (see FIG. 6D) may include a plurality of ridge elements 610 extending in the direction from the lateral side to the medial side of the sole structure 600 and a plurality of recess regions 612 extending in the direction from the lateral side to the medial side. As shown in FIG. 6D, the outsole member 600 may be constructed such that the ridge elements 610 of the second major surface 604 correspond to a back side of corresponding recess regions 608 of the first major surface 602, and the recess regions 612 of the second major surface 604 correspond to a back side of corresponding ridge elements 606 of the first major surface 602. Also, as shown in FIGS. 6A and 6D, the ridges 606, 610 and recesses 608, 612 may be arranged in an alternating manner in a direction extending from a forefoot portion to a rearfoot portion of the sole structure 600.

In at least some example outsole structures 600, as shown in FIG. 6A, at least some of the ridge elements 606 of the first major surface 602 continuously extend essentially completely across the sole structure 600 from the lateral side to the medial side (e.g., at least 75% of this distance, and in some examples at least 85% of this distance). Likewise, at least some of the recess regions 608 of the first major surface 602 continuously extend essentially completely across the sole structure 600 from the lateral side to the medial side (e.g., at least 75% of this distance, and in some examples at least 85% of this distance). Some of the recess regions 608 may extend all the way to the outsole edge and be visible from the footwear side, as shown in FIG. 1A. If desired, at least some of the corresponding ridge elements 610 and recess portions 612 of the second major surface 604 may extend essentially continuously and essentially completely across the sale structure interior 600 these same relative amounts. An additional feature that may be provided in accordance with at least some examples of this invention, as shown in FIG. 6A, relates to zig-zag or herringbone patterns of ridge elements 606 (and 610) and recess portions 608 (and 612). As further shown, the zig-zag or herringbone patterns may cover a majority of the first and/or second major surfaces 602 and 604 (e.g., at least 75% of the surface area, or even at least 85% or more of the surface area).

Additionally, if desired, one or more additional, non-herringbone or zig-zag areas may be provided as part of the sole structure 600 (e.g., areas 616 and 618 in FIG. 6A) without departing from the invention. These additional areas, when present, may be made from different and/or separate pieces of material (e.g., cemented or otherwise engaged with the remainder of the sole structure 600), and they may provide a different tread pattern, e.g., to give different traction, wear resistance, aesthetic appearance, logos or brand identifying information, and/or other desired properties or characteristics to various portions of the outsole member outer surface.

As mentioned above, the outsole member 600 may be constructed from any desired material(s) without departing from the invention, including from conventional materials known and used in the art. In at least some examples, at least the herringbone patterned portions of the first and second major surfaces 602 and 604 will be constructed from a flexible material, such as synthetic rubbers (e.g., of the types used in conventional basketball shoes, etc.). If desired, in at least some examples, the outsole member may include at least two different regions or portions, with at least one region or portion containing ridge and recess element portions and at least one region or portion not containing ridge and/or recess element portions (e.g., located around at least some portions of the perimeter of the ridge and recess containing portion(s), in the heel or toe areas, around the footwear outsole perimeter, etc.). In at least some example structures, these portions may have different thicknesses. For example, if desired, at least some of the ridge and recess element containing portions may be 1 to 2 mm thick (e.g., 1 to 1.5 mm thick in some examples), while at least some of the non-ridged and/or non-recessed portions of the outsole structure may be about 2-4 mm thick, and in some examples about 3 mm thick. In such structures 600, when the user steps down on the sole structure 600 (e.g., and applies a force having a component in a direction perpendicular to the second major surface, for example when changing directions, making a cut, landing a step or jump, etc.), at least some adjacent ridge elements 606 may splay outward somewhat under the force applied to the intermediate ridge element 610 by the foot, to thereby, in at least some arrangements, better grip the ground or other contact surface and provide better traction to the user. The differential thicknesses of the ridged and non-ridged portions of the outsole structure, in at least some examples, can positively contribute to this "splay" feature.

While any desired materials may be used for the outsole, in at least some examples, the rubber material of the outsole may be somewhat softer than some conventional outsole materials (e.g., 50-55 Shore A rubber may be used), to additionally help provide these splay/conformance characteristics. Optionally, if desired, a harder material may be used in the heel area and/or in the non-ridge and non-recess containing portions (e.g., by including an insert of 60-65 Shore A rubber around the perimeter of the heel or non-ridged portion(s)), which also can assist in providing the splay characteristics described above.

Other features of outsole members potentially available in accordance with at least some examples of the invention are illustrated in FIGS. 6A through 6D. For example, as best shown in FIGS. 6B through 6D, if desired, an impact-attenuating material 620 may be provided to at least partially fill, and in some instances completely fill, at least some of the recess regions 612 of the second major surface 604. This additional impact-attenuating material 620, which may be somewhat softer than the material from which the first and second major surfaces 602 and 604 is constructed, can help provide a smooth and comfortable surface for user foot contact while still transmitting forces to the ridge elements 610 to provide the conformance, ridge element splay, and improved traction properties as described above. The impact-attenuating material 620 may comprise a relatively soft polyurethane or other foam material, and it may be co-molded in conventional manners along with the molding process used to form at least the major portion of the remainder of the sole structure 600. Alternatively, the impact-attenuating material 620 may be provided in the outsole structure 600 in separate steps after the other major surfaces 602 and 604 are formed, if desired. While any desired impact-attenuating material having any desired degree of hardness may be used, in some examples, the impact-attenuating material 620 may have a hardness of about 35-40 Asker C (e.g., a softer material than that making up the remainder of the outsole and/or the midsole material).

FIGS. 6B and 6C further illustrate a perimeter element 622 that extends along at least a portion of a perimeter of the second major surface 604 (in this illustrated example, the perimeter element 622 is formed as a single piece and extends completely around the perimeter of the second major surface 604). This perimeter element 622 helps hold the midsole member, upper member, heel counter, and/or other structures in place, as will become more evident in description below. If desired, the perimeter element 622 may be of a sufficient height to also function as the foxing band, which is described in more detail below (thereby allowing the elimination of some or all of the foxing band).

In this illustrated example, the perimeter element 622 further includes a raised lateral edge portion 624 (e.g., at the lateral front and/or midfoot portion, at the lateral metatarsophalangeal area, near or slightly behind the lateral side toe area, etc.) extending substantially above other portions or areas of the perimeter element 622. This lateral edge portion 624 may be raised to a sufficient height (e.g., ¼ to 1 inch or higher) to help support, abut, prevent movement of, and/or contain the lateral side of the user's foot, (e.g., during a direction change, etc.). If desired, this lateral edge portion 622 may include a support member (such as a plastic or metal plate) embedded or otherwise formed therein, e.g., at area 626 as shown in FIG. 6A, to provide additional support for the lateral side of the user's foot is use (e.g., during running, direction changing, cutting, etc.), as will be described in more detail with respect to other portions of the overall sole structure. This internal plate or other support providing structure, if any, as well as the raised edge 624 and perimeter element 622, may be co-molded or otherwise incorporated in the outsole structure 600 in any desired manner, including in conventional manners known and used in the art, without departing from this invention.

Of course, the outsole structure 600 may be formed as one piece or from multiple independent pieces joined together in any desired manner, including in conventional manners known and used in the art (e.g., via adhesives, fusing techniques, etc.), without departing from this invention.

E. Example Midsole Structures

Articles of footwear in accordance with at least some examples of this invention further may include a midsole member, e.g., provided between an outsole member and one or more of a bootie element, another midsole structure, a sock liner, an upper member, etc.

FIGS. 7A through 7D illustrate an example midsole element 700 that may be used in articles of footwear and other foot-receiving devices in accordance with at least some examples of this invention. This example midsole element 700 includes a base member 702 at least partially made from or otherwise including an impact-attenuating material. This base member 702 includes a front or forefoot portion, a rear portion, a medial side portion, and a lateral side portion, and may be designed to completely support the wearer's foot. Any desired impact-attenuating material may be used for the base member 702 without departing from the invention, including conventional materials known and used in the art, such as foam materials, ethylvinylacetate materials, polyurethane materials, and the like. While any desired midsole materials having any desired degree of hardness or other characteristics may be used, in some examples of the invention, the midsole element 700 will have a hardness of 46±2 Asker C. Optionally, if desired, the heel may have a somewhat higher hardness value (e.g., a triangular section in the heel area of about 55±2 Asker C). Other areas of different hardness or other properties from that making up the bulk of the midsole element 700 also may be provided, if desired, e.g., by providing layers of materials having the desired properties, for example, in the arch or forefoot areas.

In at least some example structures 700, the base member 702 will include a moderator element 704 engaged therewith, e.g., adhered to an outer surface thereof, at least partially embedded therein, etc. In this illustrated example structure 700, the moderator element 704 is completely embedded within the base member (e.g., through a co-molding process). The moderator element 704 may have a thin plate or sheet like structure, e.g., made from reinforced plastics, thermoplastic polyurethane, fiberglass, or other suitable material (e.g., 30% glass fiber in nylon 66), and it may include first and second leg members 704*a* and 704*b* extending generally in a longitudinal direction of the base member 702 and a base portion 704*c* connecting the leg members 704*a* and 704*b*. Each leg member 704*a* and 704*b* includes a free end located at or toward the front portion of the base member 702, and each leg member 704*a* and 704*b* extends from its free end toward the base portion 704*c* located in or toward the rear (heel) portion of the base member 702. With this structure and construction, the moderator element 704 may allow at least some medial-lateral splay and conformance in the forefoot portion (e.g., due to the free ends of the moderator element 704), and it may create an appropriate flex point at the metatarsophalangeal or other joints, while still providing moderate and sufficient torsional rigidity and moderated deflection in the heel region (e.g., due to the stiffer and more structurally rigid base portion 704*c*).

Similar to the outsole structure 600 described above in conjunction with FIGS. 6A through 6D, in at least some examples of this invention, the midsole element 700 may include a perimeter element 706 that extends from a surface of the base member 702 along at least a portion of a perimeter of the surface. If desired, in at least some examples, the perimeter element 706 may be formed as a single piece with the base member 702, it may extend around the entire perimeter of the surface, and/or it may smoothly slope in a continuous manner to the surface.

In at least some example structures 700, the perimeter element 706 additionally will include an extending portion 708 at least along a portion of the lateral side of the base member 702 (e.g., at or near the fifth metatarsophalangeal joint or somewhat back from the smallest toe). If desired, an additional supporting element or structure (such as a plastic or metal plate) may be provided in this lateral side extending portion 708 of the perimeter element 706, e.g., so as to provide additional support and stability for the lateral side of the foot, for example, during direction changes, cutting actions, etc. This extending portion 708 may be provided to at least partially support, abut, contain, or otherwise engage the lateral side of the foot (e.g., at the fifth metatarsophalangeal area). This extending portion 708 may be any desired height, e.g., from ¼ to 1 inch high or higher, if desired.

At least some portions of the perimeter element 706, and particularly the extending portion 708, when present, may include one or more discontinuity regions 710 (e.g., along the lateral side of the base member 702, as part of the extending portion 708, etc.). These discontinuity regions 710, when present, may provide additional flexibility and allow the perimeter element 706 and/or the extending portion thereof 708 to better conform to the wearer's lateral foot area, e.g., during movement.

Figure 7A:
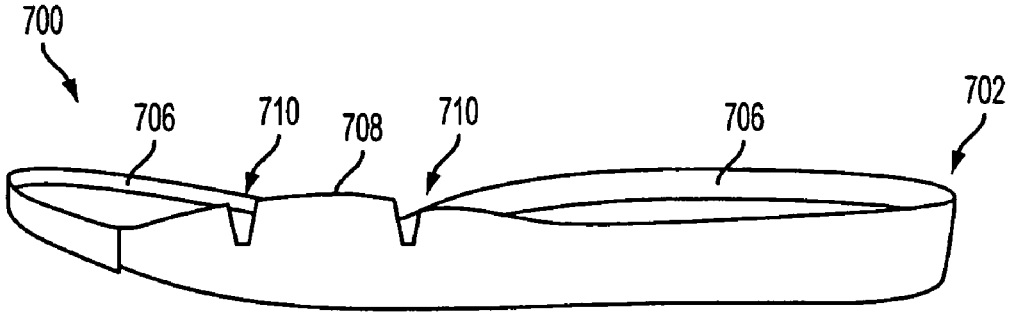
FIGS. 7A through 7D illustrate various views of an example midsole structure that may be used in products in accordance with at least some examples of this invention.
Figure 7B:
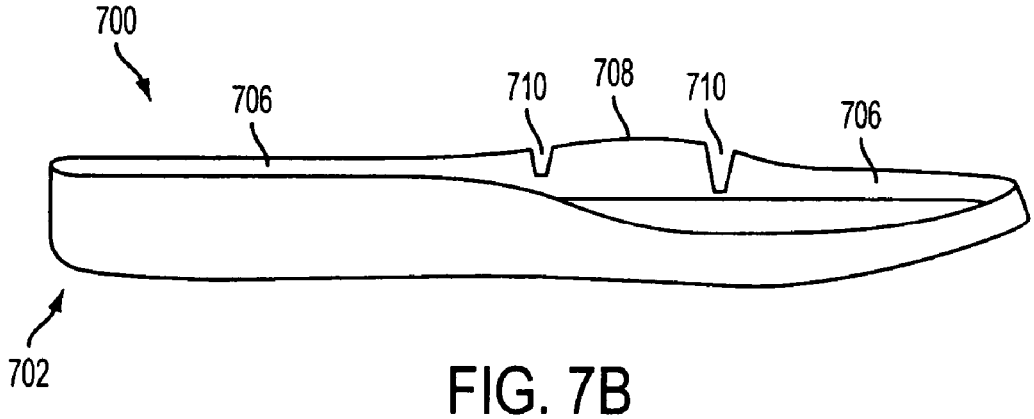
Figure 7C:
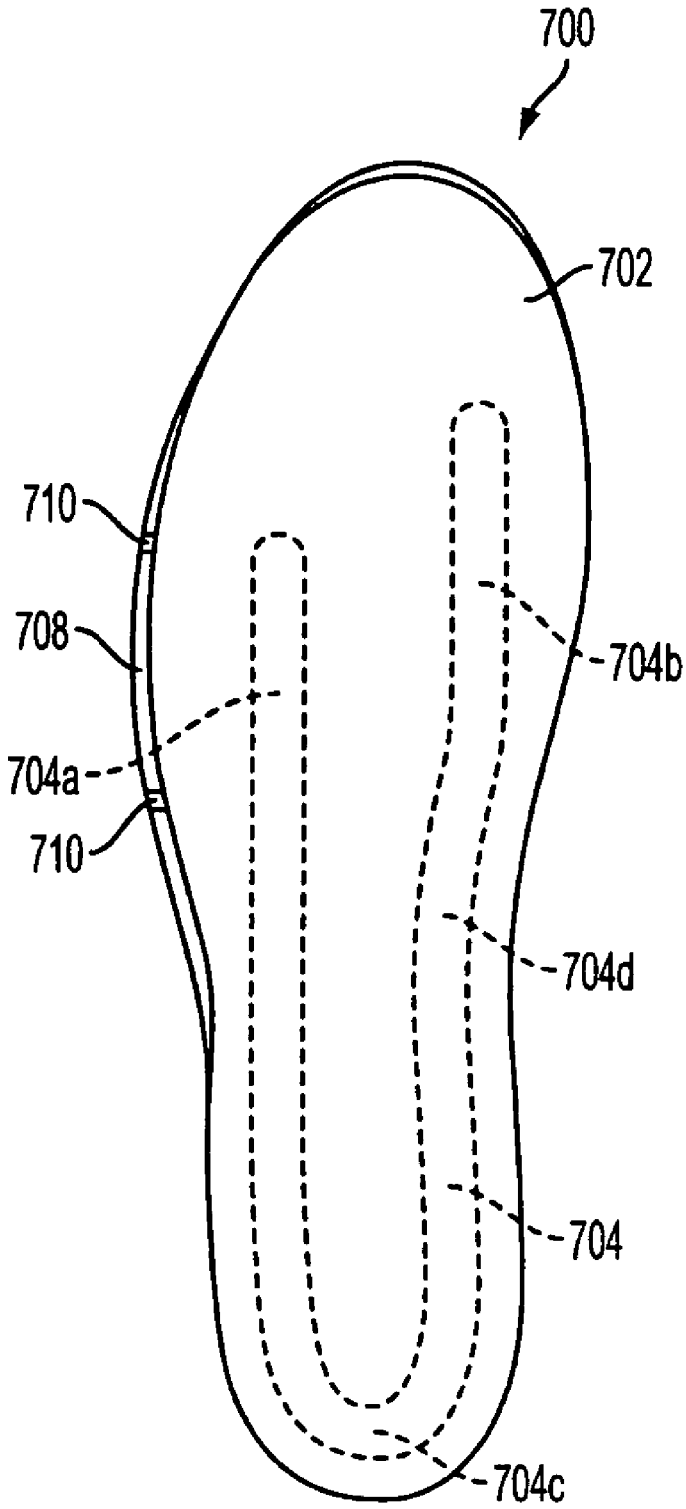
Figure 7D:
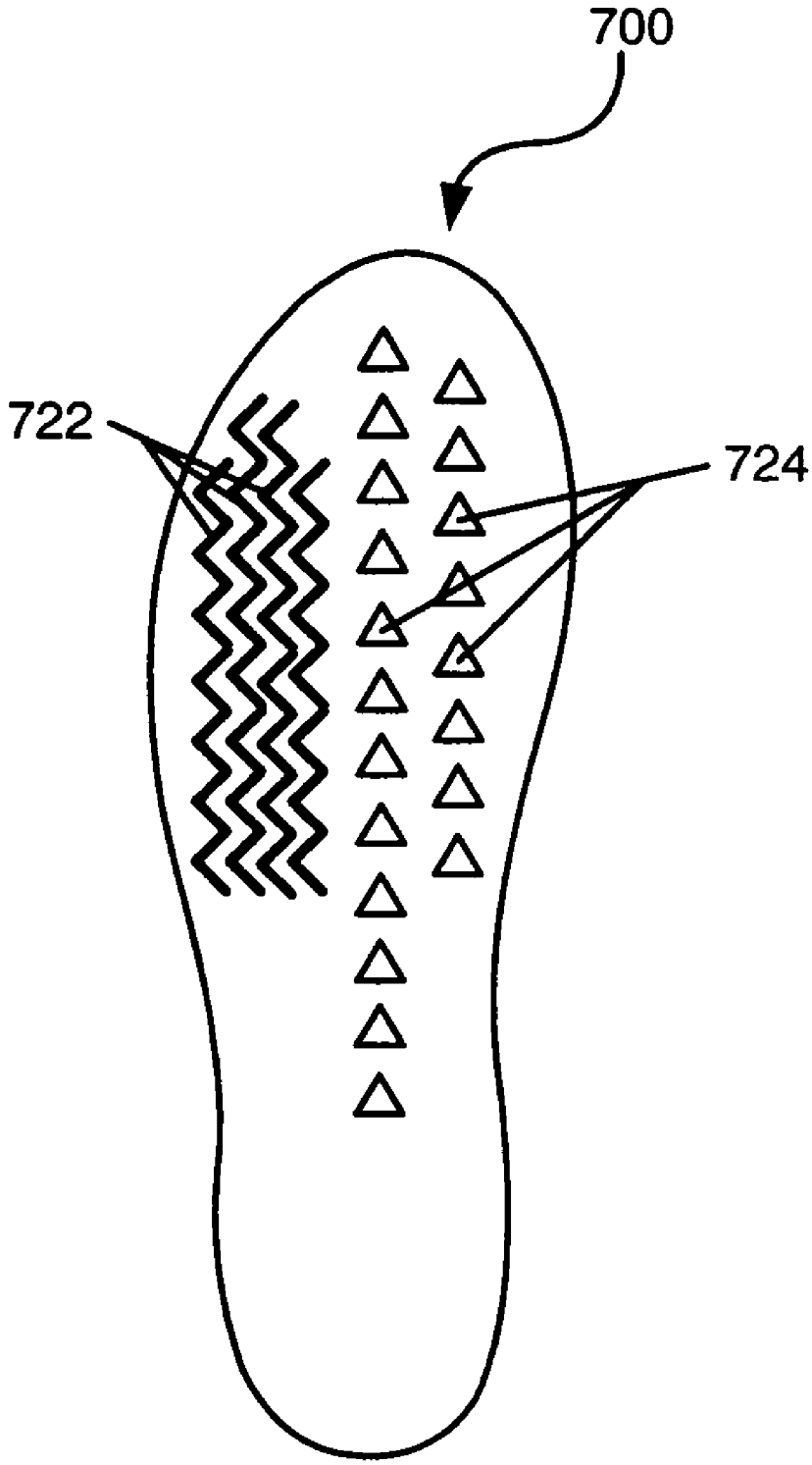

FIG. 7D illustrates a bottom surface 720 of a midsole element 700 in accordance with at least some examples of this invention. As shown, the bottom surface 720 may include various features to improve splay and/or conformance characteristics of the midsole element 700 (e.g., to help provide a supple shoe/foot interface and shoe/ground interface, to help improve splaying of the midsole element 700, to improve conformance of the midsole element 700 to the contact surface and/or the user's foot, etc.). These splay and/or conformance-enhancing features may take on various forms without departing from this invention. For example, as illustrated in FIG. 7D, the splay and/or conformance-enhancing features may take the form of cuts or siping elements 722 that generally extend in the longitudinal direction on the bottom surface 720 of the midsole element 700. One or more of these cut or siping elements 722 may be provided, and they may extend all the way through the thickness of the midsole element 700, partially through the thickness thereof, or some combination thereof. The cut or siping elements 722 also may extend continuously or discontinuously any desired distance in the longitudinal direction, and they may be particularly useful at least in the forefoot portion of the midsole element 700. While the cuts 722 may take on any desired size, shape, spacing, direction, or other characteristics, in at least some examples as illustrated in FIG. 7D, the cuts extend partially through the midsole element 700, and they generally extend substantially parallel to the longitudinal direction and to the moderator element legs, optionally in a zig-zag, straight, curved, or other extending manner.

Additionally or alternatively, as also illustrated in FIG. 7D, the supple interface, splay, and/or conformance characteristics described above also may be provided, in at least some examples of this invention, by providing one or more cutout portions 724 in at least the bottom surface 720 of the midsole element 700. These cutout portions 724 may extend any desired distance through the midsole element 700 (including all the way through, if desired), and they may be located at any desired positions to provide the desired interface, splay, and/or conformance characteristics. Of course, any number of cutout portions 724 may be provided, and they may be provided in any desired arrangement and/or shapes (straight longitudinal arrangements of triangular cutouts are illustrated in FIG. 7D) without departing from this invention.

Figure 7E:
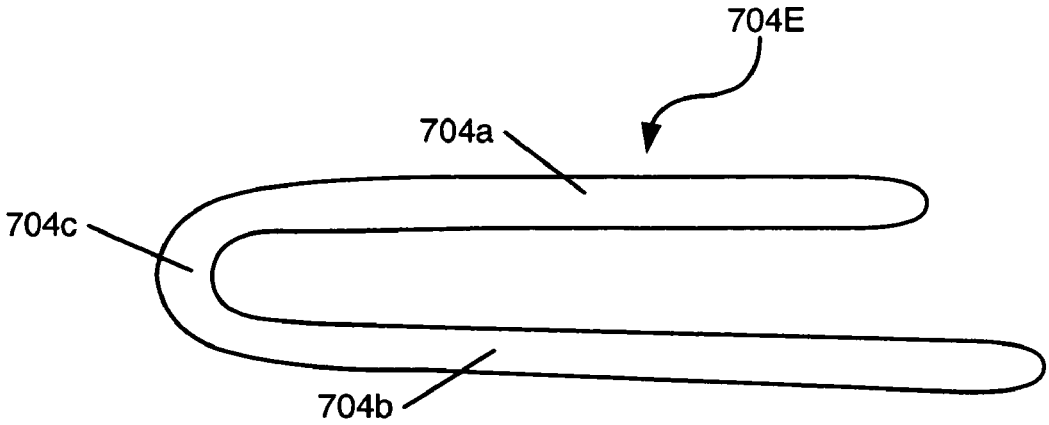
FIGS. 7E and 7F illustrate additional examples of moderator member structures that may be used in products in accordance with at least some examples of this invention.
Figure 7F:
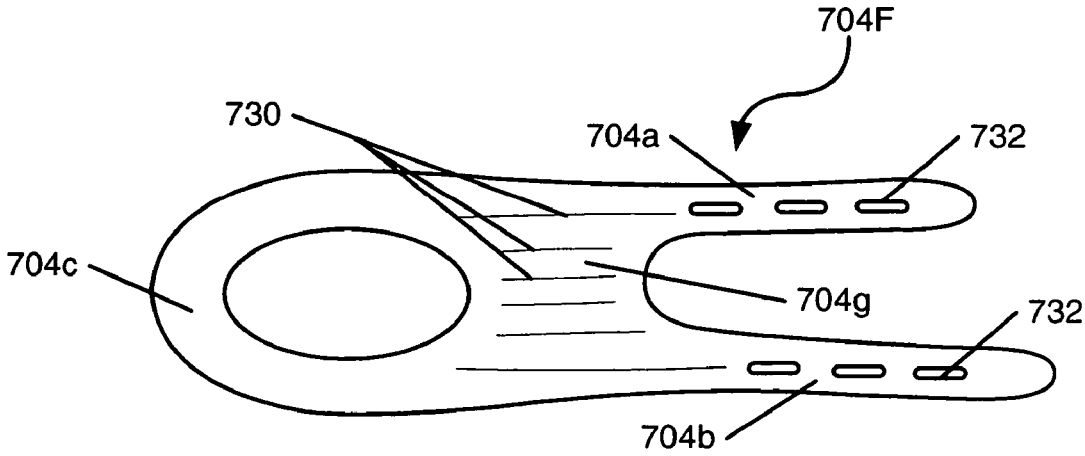

FIGS. 7E and 7F provide additional examples of moderator elements that may be used in accordance with at least some examples of this invention. As shown in FIG. 7C, this moderator member 704 includes one relatively straight leg 704*a* and one leg 704*b* with an offset portion 704*d*. FIG. 7E, on the other hand, illustrates an example moderator element 704E that includes two relatively straight leg members 704*a* and 704*b* that are parallel or substantially parallel (e.g., somewhat divergent as one moves away from the base portion 704*c*). Such moderator elements 704E can allow adequate splay and conformance while still controlling the flex point, providing adequate support, and controlling midfoot torsion.

In situations (e.g., shoe designs, etc.) where additional midfoot support and torsion resistance and control are desired, a moderator element 704F of the type illustrated in FIG. 7F may be provided. In this example structure 704F, the two legs 704*a* and 704*b* and base portion 704*c* of the moderator element 704F remain, but the two legs 704*a* and 704*b* also are connected by an intermediate portion 704*g*. This intermediate portion 704*g* may be formed of the same material and contiguous with the material making up the legs 704*a* and 704*b* (e.g., the entire moderator element 704F may be a single, one piece construction), and it may be made any desired size without departing from this invention. Additionally, as illustrated in FIG. 7F, if desired, the intermediate portion 704*g* may include a waved or ruffled structure (both sides may include the waved or ruffled structure, as illustrated by peaks 730 in the intermediate portion 704*g*), to enable further control over the stiffness, support, midfoot torsion, flex point, and other characteristics of the overall shoe and/or sole structure. Still further, if desired, openings 732 may be provided, e.g., in the legs 704*a* and 704*b* or other portions of the moderator element structure 704F (or moderator elements 704 and 704E described above), to allow further control over the stiffness, support, torsion, and/or flex characteristics.

If desired, in accordance with at least some examples of the invention, midsole elements 700 of the types described above may be engaged on one surface with an outsole member, e.g., of the types described in conjunction with FIGS. 6A through 6D, and on an opposite surface thereof with a bootie element, heel counter, sock liner, and/or upper member structure, e.g., of the types described above in conjunction with FIGS. 2 through 5. Connections may be made in any suitable or desired manner without departing from the invention, including in conventional manners known and used in the art, such as via adhesives, sewing or stitching, other fusing techniques, etc.

F. Example Footwear and Foot-Receiving Device Construction Processes

Many ways of making articles of footwear or other foot-receiving device products including features and aspects of the invention may be used. The following describes some potential construction procedures that may be used in conjunction with the various individual parts described above (e.g., the bootie, upper member, outsole member, midsole member, etc.), e.g., for producing footwear structures of the types shown in FIGS. 1A through 1C. While the various references numbers from FIGS. 1A through 7C may be used in the description below, those skilled in the art will recognize that variations in the specific structures may be provided without departing from the invention (i.e., the reference numbers are used only for example and reference purposes, not in a limiting manner). FIGS. 8A through 8J also illustrate various portions of an assembled article of footwear and/or portions thereof, and particularly areas of the foot-supporting portions, in various plan or sectional views. The reference numbers used in FIGS. 8A through 8J also correspond to those used in other figures.

In general, a bootie blank 200 may be formed into a bootie member 300 or 502, optionally including a tongue portion 220, and joined to an upper member 504, e.g., in the manners described above in conjunction with FIGS. 2-5. Separately, an outsole member 600 may be provided, e.g., of the types described above in conjunction with FIGS. 6A through 6D, optionally including an extending edge or perimeter portion 624 at least along the lateral side, e.g., by molding processes as described above. Also, separately, a midsole member 700 may be provided, e.g., of the types described above in conjunction with FIGS. 7A through 7F, optionally including an extending edge or perimeter portion 708 at least along the lateral side, e.g., by molding processes as described above.

A heel counter 506 for additional heel and structural support may be attached to the bootie element 300 or 502, e.g., directly attached to the bootie element 300 or 502 using adhesives, and then the bootie element 300 or 502 may be attached to a midsole member 700, e.g., directly attached using adhesives. Direct attachment in these areas can be desirable, at least for some footwear structures, because direct attachment provides the impact-attenuation elements very close to the user's foot. Additionally, the resulting footwear structure may have a relatively low, close to the ground construction and feel that may be somewhat lower than many conventional athletic shoe sole structures. Some users may prefer or enjoy this low and close look and feel, at least for some activities.

Once the bootie element 300 or 502 is attached to the midsole 700, the upper member 504 (which was previously attached to the bootie element 300 or 502 and remained loose around its bottom portion as shown in FIG. 5) may be lasted (e.g., double lasted) around the exterior sides and bottom of the midsole 700 (optionally attached via adhesive, stitching, or other appropriate means to the midsole 700). Because of the direct contact between the bootie element 300 or 502 and the midsole member 700, the flexible construction of the upper member 504, and the flexible nature of the heel counter member 506 in this example structure, the upper member 504 may be closely lasted to the sole structure (e.g., to midsole member 700) such that the upper member 504 closely fits and conforms to the midsole structure 700. The resulting overall upper member structure in the final product can closely conform to the wearer's foot and provide a comfortable fit. Next in the production procedure, the outsole member 600 may be engaged with the midsole element 700 such that the upper member 504, at least in part, extends between the midsole element 700 and the outsole member 600 (e.g., between their side surfaces and/or between the bottom surface of the midsole 700 and the top (interior) surface of the outsole 600). Adhesive may be applied to hold the outsole member 600 to the remainder of the structure (e.g., to one or more of the upper member 504, midsole element 700, etc.). If desired, a toe cap element 118 may be provided over the upper member 504 and engaged therewith (e.g., via adhesive, stitching, etc.). The toe cap element 118 also may extend to an area between the midsole element 700 and the outsole element 600, if desired.

Figure 8A:
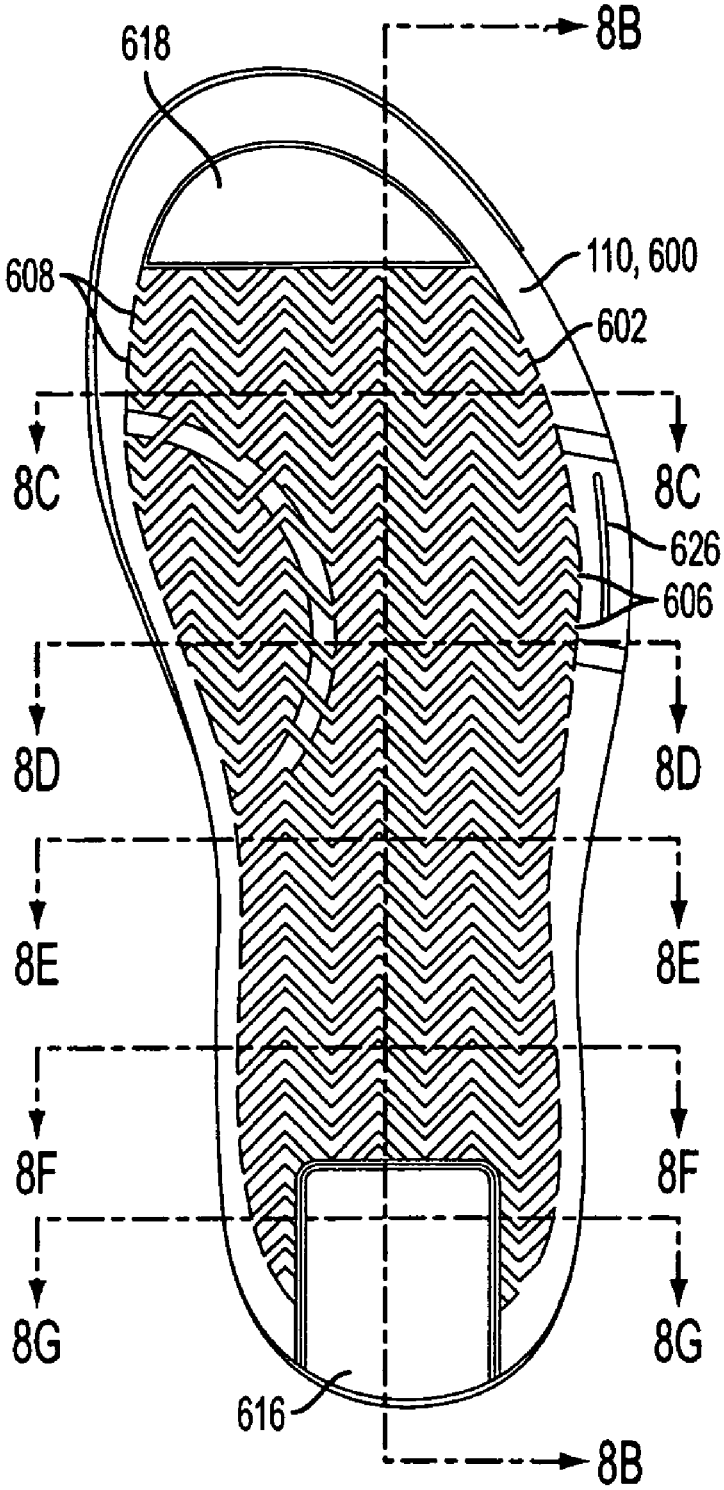
FIGS. 8A through 8J illustrate various plan and sectional views of sole structures and other footwear components that may include features according to the present invention.
Figure 8B:
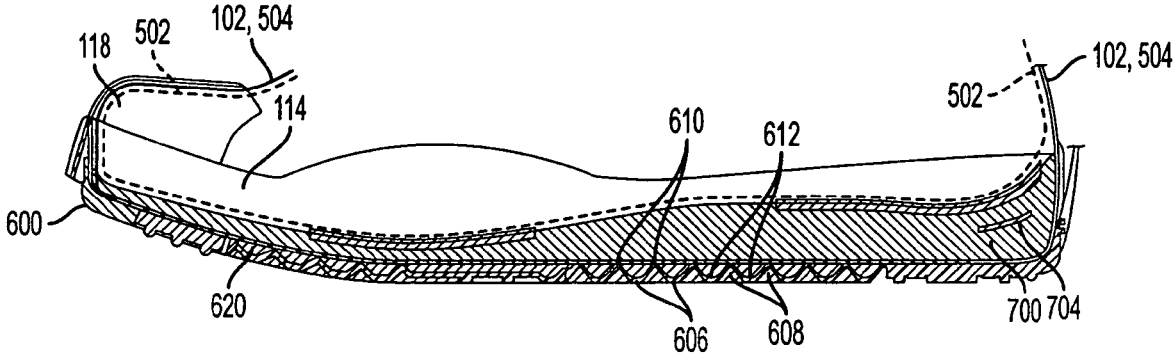
Figure 8C:
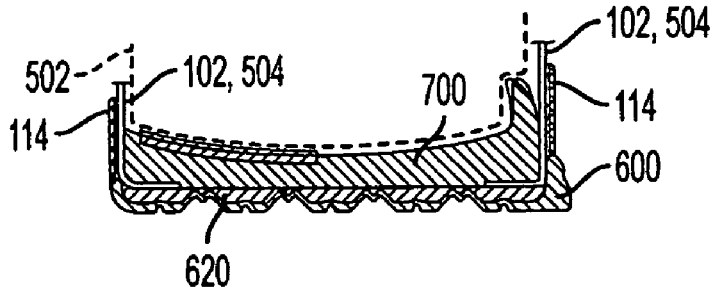
Figure 8D:
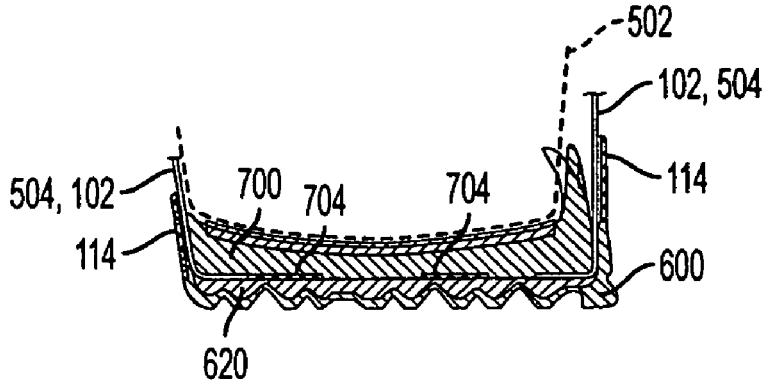
Figure 8E:
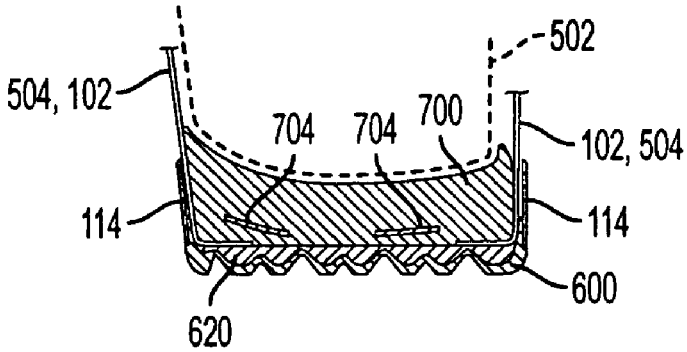
Figure 8F:
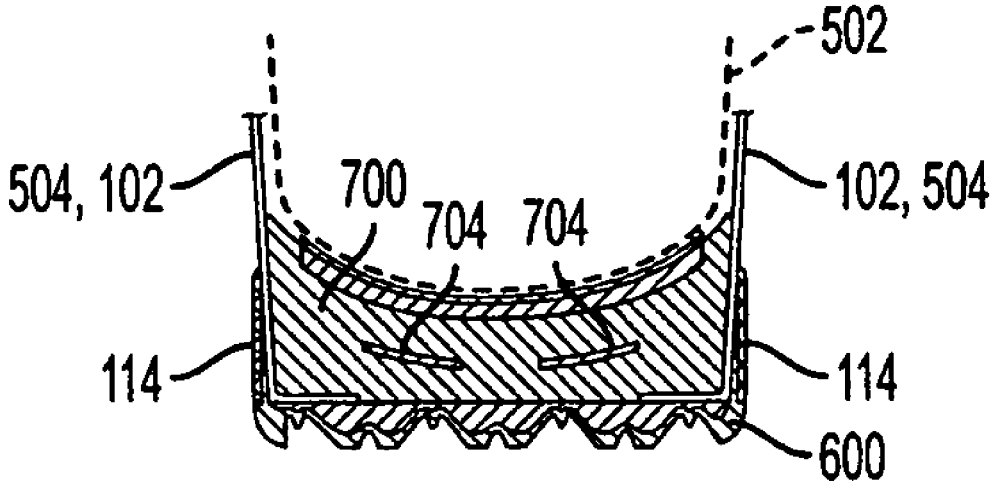
Figure 8G:
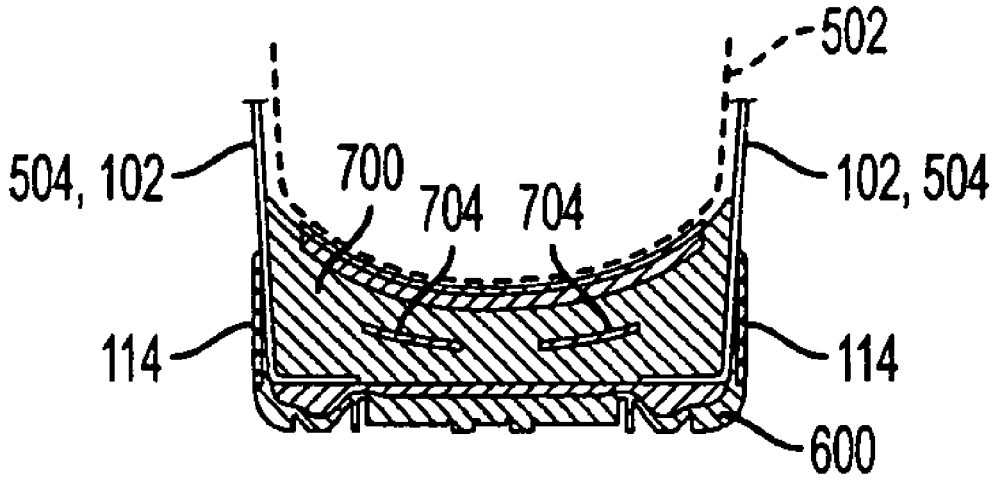
Figure 8H:
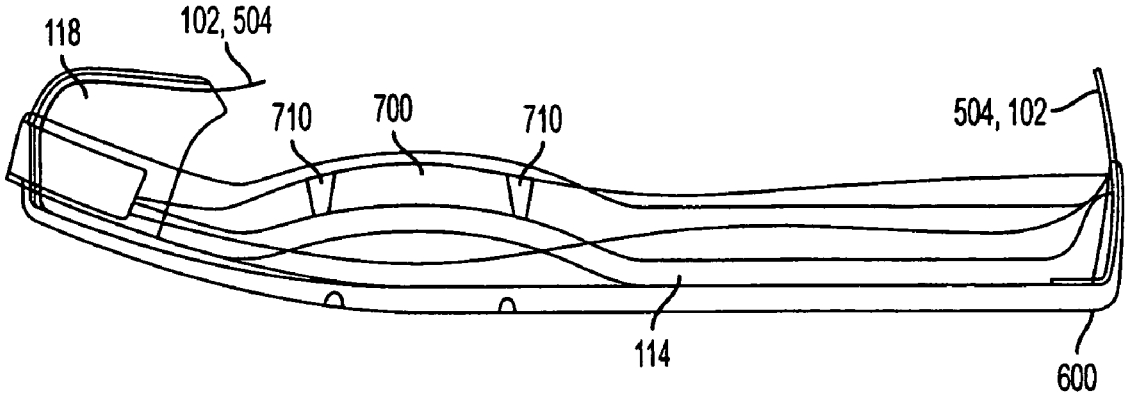
Figure 8I:
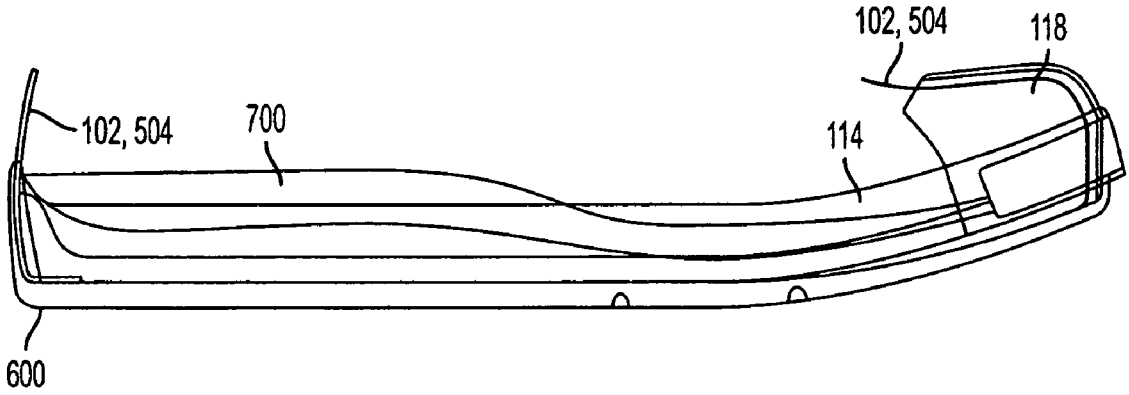
Figure 8J:
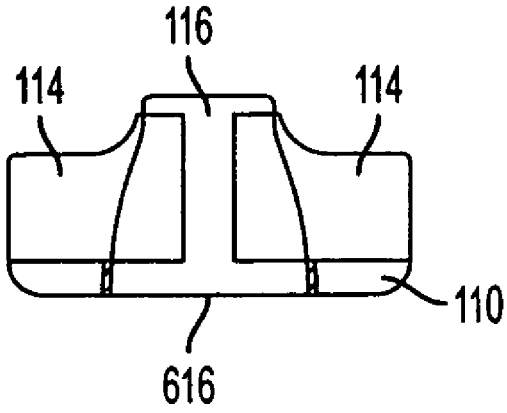
Figure 9:
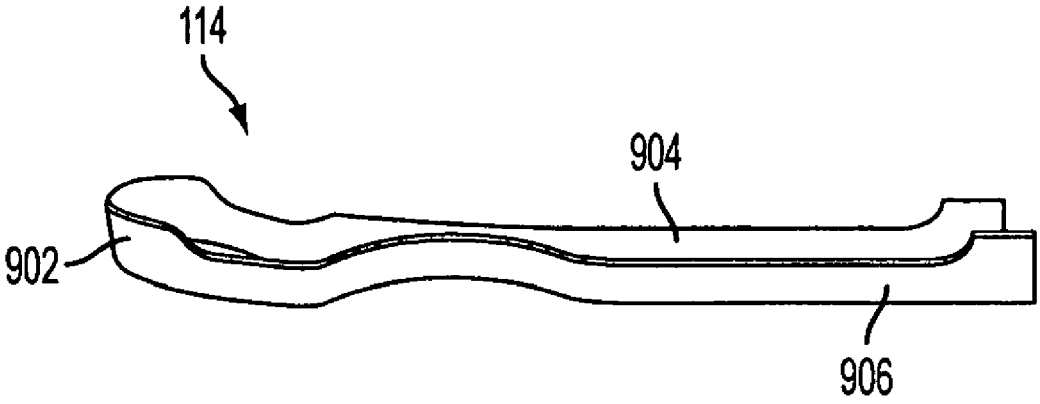
FIG. 9 illustrates an example foxing strip member that may be used in products in accordance with at least some examples of this invention.

Once constructed, at least a portion of the bottom exterior of the midsole element 700 fits within the perimeter member 622 of the outsole element 600 such that the lateral extending edge portion 708 of the midsole element 700 also fits at least partially within and is supported by the lateral extending edge portion 624 of the outsole element 600 (see also FIGS. 1A and 1C). At this stage, if desired, one or more foxing bands 114 may be provided (see also FIG. 9) around at least a portion of the perimeter of the footwear structure 100 (and in some cases around the entire or essentially the entire perimeter). In this illustrated example, the foxing band 114 includes a toe covering portion 902 and two side portions 904 and 906, and the band 114 covers the junctions between the outsole element 600, the upper member 504, the toe cap 118, and/or the midsole 600. Adhesive, stitching, or other means can hold the foxing band 114 to the remainder of the shoe structure. If desired, as illustrated in FIGS. 1C, 6A, and 8E, a portion 618 of the outsole member 600 may extend, e.g., around the heel area of the shoe 100, to cover and hold the two free ends of the foxing band 114. Of course, other ways of holding the foxing band 114 in place may be used without departing from this invention (e.g., the foxing band 114 may have a continuous band structure that is held in place by adhesives and/or elasticity characteristics of the band 114). Also, if desired, multiple independent pieces may make up the foxing band 114 without departing from the invention. As still another example, if desired, the foxing band 114 may be omitted (optionally, if desired, a "cup" sole member may be provided, e.g., as an outsole member, and the upper, open perimeter end of the cup sole can appear and/or perform functions similar to those provided by the foxing band 114).

Of course, other structures, features, design elements, and the like may be included in the shoe structure, the order of the various construction steps may be changed, additional steps may be added, steps may be deleted, and the like, without departing from the invention. Also, additional design elements, such as patches, piping, logos, stickers, trim elements, laser trim, and the like may be provided at any suitable or desired time in the construction process without departing from this invention. At any suitable or desired time, when present, the openings 120 in the upper member structure 102 may be covered with additional material 122, such as an additional layer of bootie material 230 (e.g., by sewing, etc.), a patch member, etc., as described above.

G. Other Potential Features

Figure 10:
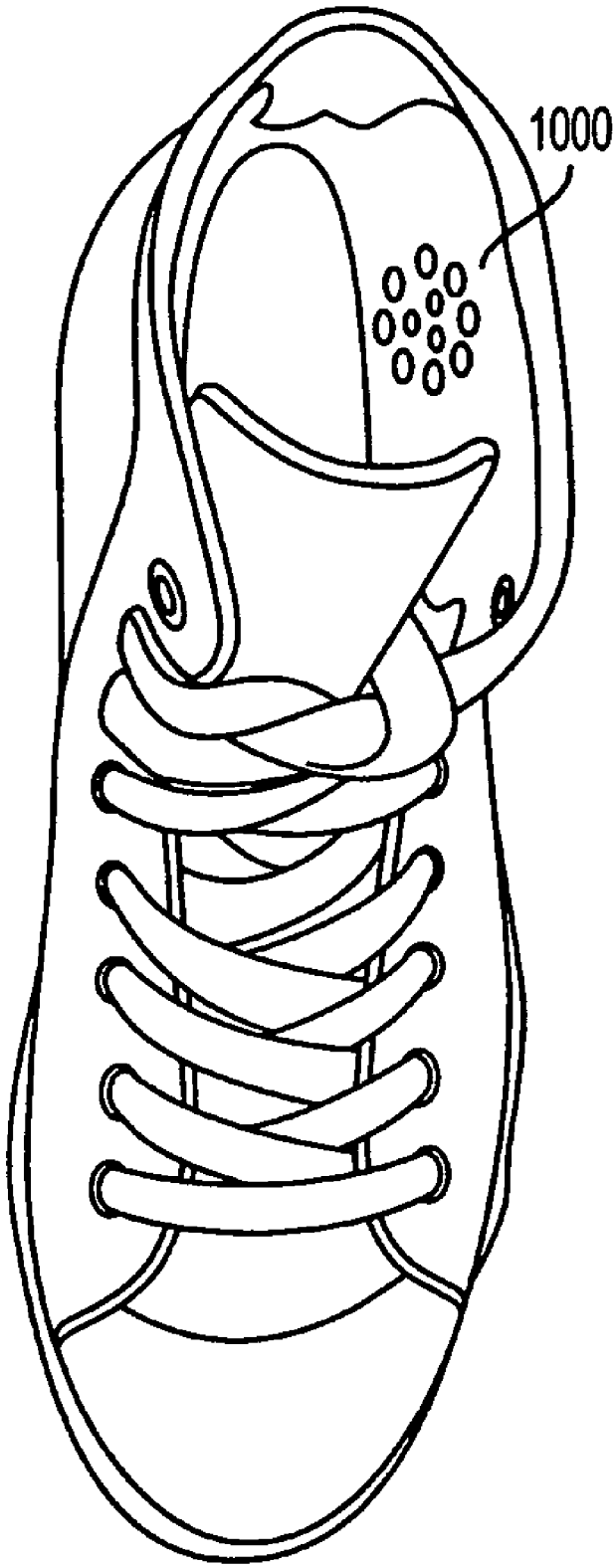
FIG. 10 illustrates example proprioception areas that may be provided in products in accordance with at least some examples of this invention.

Of course, articles of footwear and other foot-receiving devices may have a wide variety of features, constructions, and combinations of features and constructions without departing from this invention. For example, if necessary or desired, the upper member 102 and/or the bootie element 202 may include one or more vent structures (e.g., open eyelets, slits, slots, vanes, etc.), to enable increased breathability. As another example, if desired, as shown in FIG. 10, interior surfaces on the bootie member (e.g., inside the foot-receiving chamber) may include one or more slightly raised elements or nubs 1000 at appropriate locations to stimulate nerves and/or to cause automatic or reflexive action by the shoe wearer (e.g., also called "proprioception elements"). For example, providing these slightly raised elements 1000 at the ankle area, as illustrated in FIG. 10 (e.g., at the location(s) of the open areas 120 of the upper member 102 and the double layer of material 230 provided thereat, in some example structures), can help the wearer better feel and/or more quickly process and/or take corrective action when downward pressure (during a downstep, jump landing, etc.) is somewhat off-center or at a bad angle. For example, in at least some instances, this early feedback through the wearer's nervous system, due to contact of the ankle with the raised elements 1000, can provide sufficient advance warning to enable the user to automatically and reflexively take corrective action, e.g., to correct the landing characteristics, to reduce the incident weight or force on one leg and/or shift weight or force to the other leg, to cause the other leg to land more quickly and thereby reduce the incident force on the leg in improper position, etc.

IV. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1A-10 may be used individually and/or in any combination or subcombination without departing from this invention.

We claim:

1. An interior member for a foot-receiving device comprising:

a first material element having a length defined in a toe to a heel direction and a width defined in a medial to a lateral direction, the first material element at least partially defining a foot-receiving chamber, the first material element including, a plantar portion forming a bottom surface of the interior member, a heel-surrounding portion seamlessly connected to the plantar portion and extending-upward from a rear end of the plantar portion, a lateral side portion seamlessly connected to the plantar portion and extending upward from a lateral side of the plantar portion, a medial side portion seamlessly connected to the plantar portion and extending upward from a medial side of the plantar portion, and an Achilles portion that forms a double layer along an Achilles region of the foot-receiving chamber, the Achilles portion being elongated and having a width measured in the medial to the lateral direction that is smaller than a width of the heel-surrounding portion measured in the medial to the lateral direction; and the first material element includes the plantar portion, the heel-surrounding portion, the lateral side portion, the medial side portion; and the Achilles portion in a continuous, one-piece arrangement, wherein the plantar portion is seamless, such that the bottom surface of the interior member has no seams thereon.

2. An interior member according to claim 1, further comprising:

a second material element including a tongue portion engaged with the first material element, the second material element at least partially defining an instep portion of the foot-receiving chamber.

3. An interior member according to claim 2, wherein a first seam joins a lateral edge of the heel-surrounding portion with a first lateral edge of the lateral side portion, wherein a second seam joins a medial edge of the heel-surrounding portion with a first medial edge of the medial side portion, wherein a third seam joins a lateral edge of the tongue portion with a second lateral edge of the lateral side portion, and wherein a fourth seam joins a medial edge of the tongue portion with a second medial edge of the medial side portion.

4. An interior member according to claim 3, wherein the tongue portion is a formed as a separate member from the first material element, and the third seam and the fourth seam extend around at least a portion of a front edge of the first material element and connect the front edge of the first material element to at least a portion of a front edge of the tongue portion.

5. An interior member according to claim 1, wherein the first material element includes a non-porous layer and an impact-attenuating layer.

6. An interior member according to claim 1, wherein the first material element forms a double layer at a lateral ankle edge portion of the foot-receiving chamber.

7. An interior member according to claim 1, wherein the first material element forms a double layer at a medial ankle edge portion of the foot-receiving chamber.

8. An interior member according to claim 1, wherein the first material element forms a double layer at a lateral ankle edge portion, at a medial ankle edge portion, and along an Achilles portion of the foot-receiving chamber.

9. An interior member according to claim 1, wherein the first material element extends from the heel-surrounding portion to provide an ankle-containing portion.

10. An interior member according to claim 1, wherein a first seam joins a lateral edge of the heel-surrounding portion with a first lateral edge of the lateral side portion, and wherein a second seam joins a medial edge of the heel-surrounding portion with a first medial edge of the medial side portion.

11. A foot-receiving device, comprising:

a bootie element defining a foot-receiving chamber, the bootie element including, a first material element having a plantar portion forming a bottom surface of the bootie element, the first material element having a length defined in a toe to a heel direction and a width defined in a medial to a lateral direction, a heel-surrounding portion seamlessly connected to the plantar portion and extending-upward from a rear end of the plantar portion, a lateral side portion seamlessly connected to the plantar portion and extending upward from a lateral side of the plantar portion, a medial side portion seamlessly connected to the plantar portion and extending upward from a medial side of the plantar portion, and an Achilles portion that forms a double layer along an Achilles region of the foot-receiving chamber, the Achilles portion being elongated and having a width measured in the medial to the lateral direction that is smaller than a width of the heel-surrounding portion measured in the medial to the lateral direction;

the first material element includes the plantar portion, the heel-surrounding portion, the lateral side portion, and the medial side portion in a continuous, one-piece arrangement, wherein the plantar portion is seamless, such that the bottom surface of the bootie element has no seams thereon;

the first material element forms a double layer at a lateral ankle edge portion of the foot-receiving chamber; and a first foot-receiving device component engaged with the bootie element.

12. A foot-receiving device according to claim 11, wherein the first foot-receiving device component includes at least a portion of a sole member for an article of footwear, the sole member positioned beneath the bottom surface of the bootie element.

13. A foot-receiving device according to claim 11, wherein the first foot-receiving device component includes at least a portion of a midsole member for an article of footwear, the midsole member positioned beneath the bottom surface of the bootie element.

14. A foot-receiving device according to claim 11, wherein the first foot-receiving device component includes at least a portion of an upper member for an article of footwear, the upper member being-positioned around at least a portion of the heel-surrounding-portion, the medial side portion, and the lateral side portion of the bootie element.

15. An interior member according to claim 14, wherein the foot-receiving device is an athletic shoe, and wherein the first foot-receiving device component further comprises an impact-attenuating member positioned beneath the bottom surface of the bootie element and beneath the upper member, and wherein a bottom inner surface of the bootie element defines a bottom surface of the foot-receiving chamber with no additional impact-attenuating member positioned above the bottom inner surface of the bootie element within the foot-receiving chamber.

16. A foot-receiving device according to claim 14, wherein at least a major portion of the upper member is formed from an unstretchable material.

17. A foot-receiving device according to claim 14, wherein at least a major portion of the upper member is formed from a canvas material.

18. A foot-receiving device according to claim 11, wherein the foot-receiving device is an article of athletic footwear.

19. A foot-receiving device according to claim 11, wherein the foot-receiving device is a high top athletic shoe and the bootie element extends so as to provide an ankle-containing portion.

20. A foot-receiving device according to claim 11, wherein the first foot-receiving device component includes an upper member for an article of footwear, and the foot-receiving device further includes:

a sole member engaged with the bootie element.

21. A foot-receiving device according to claim 11, wherein the first foot-receiving device component includes an upper member for an article of footwear, and the foot-receiving device further includes:

a midsole member engaged with the bootie element; and an outsole member engaged with the midsole element.

* * * * *